US012673238B2

(12) United States Patent
Zhang et al.

(10) Patent No.: US 12,673,238 B2
(45) Date of Patent: Jul. 7, 2026

(54) PHOTOPLETHYSMOGRAPHY (PPG) BASED CONTROL METHOD AND ELECTRONIC DEVICE

(71) Applicant: HONOR DEVICE CO., LTD., Shenzhen (CN)

(72) Inventors: Xiaowu Zhang, Shenzhen (CN); Danhong Li, Shenzhen (CN); Haoxuan Di, Shenzhen (CN)

(73) Assignee: Honor Device Co., Ltd., Shenzhen (CN)

( * ) Notice: Subject to any disclaimer, the term of this patent is extended or adjusted under 35 U.S.C. 154(b) by 0 days.

(21) Appl. No.: 18/251,511

(22) PCT Filed: Sep. 16, 2022

(86) PCT No.: PCT/CN2022/119362

§ 371 (c)(1),
(2) Date: May 2, 2023

(87) PCT Pub. No.: WO2023/124261

PCT Pub. Date: Jul. 6, 2023

(65) Prior Publication Data

US 2025/0065191 A1 Feb. 27, 2025

(30) Foreign Application Priority Data

Dec. 29, 2021 (CN) ..... 202111649199.7

(51) Int. Cl.
*A63B 24/00* (2006.01)

(52) U.S. Cl.
CPC ..... *A63B 24/0062* (2013.01); *A63B 2220/44* (2013.01); *A63B 2220/56* (2013.01);
(Continued)

(58) Field of Classification Search
CPC ..... A61B 5/02416; A61B 5/02438; A61B 5/02427
See application file for complete search history.

(56) References Cited

U.S. PATENT DOCUMENTS

2005/0187446 A1 8/2005 Nordstrom et al.
2007/0208240 A1 9/2007 Nordstrom et al.
(Continued)

FOREIGN PATENT DOCUMENTS

CN 1692874 A 11/2005
CN 1929777 A 3/2007
(Continued)

*Primary Examiner* — George R Evanisko
(74) *Attorney, Agent, or Firm* — Fish & Richardson P.C.

(57) ABSTRACT

Embodiments of this application provide a photoplethysmography (PPG) based control method and an electronic device and relate to the field of terminal technologies. The method includes: using, by the electronic device, the plurality of LEDs to emit a light signal corresponding to a first current; using, by the electronic device, at least one of the plurality of PDs to obtain a second current returned by the light signal corresponding to the first current via a human tissue; and reducing, by the electronic device, the first current by using a preset first current step size when the electronic device determines that the second current is greater than a target current; or increasing, by the electronic device, the first current by using the preset first current step size when the electronic device determines that the second current is less than the target current.

19 Claims, 13 Drawing Sheets

(52) U.S. Cl.
CPC ..... *A63B 2220/836* (2013.01); *A63B 2230/06* (2013.01); *A63B 2230/207* (2013.01); *A63B 2230/42* (2013.01); *A63B 2230/50* (2013.01)

(56) References Cited

U.S. PATENT DOCUMENTS

| | | | | |
|---|---|---|---|---|
| 2014/0275850 | A1 | 9/2014 | Venkatraman et al. | |
| 2014/0275852 | A1* | 9/2014 | Hong | A61B 5/0002 600/479 |
| 2014/0275854 | A1 | 9/2014 | Venkatraman et al. | |
| 2015/0025394 | A1 | 1/2015 | Hong et al. | |
| 2017/0007185 | A1 | 1/2017 | Lin et al. | |
| 2017/0105638 | A1* | 4/2017 | Kulach | A61B 5/1118 |
| 2017/0309670 | A1 | 10/2017 | Shao et al. | |
| 2020/0100693 | A1 | 4/2020 | Velo et al. | |
| 2020/0337574 | A1 | 10/2020 | Foroozan et al. | |
| 2022/0142489 | A1 | 5/2022 | Ni et al. | |
| 2023/0045200 | A1 | 2/2023 | Shan et al. | |

FOREIGN PATENT DOCUMENTS

| | | | |
|---|---|---|---|
| CN | 104207755 | A | 12/2014 |
| CN | 105910632 | A | 8/2016 |
| CN | 108652605 | A | 10/2018 |
| CN | 109350021 | A | 2/2019 |
| CN | 109863703 | A | 6/2019 |
| CN | 110769561 | A | 2/2020 |
| CN | 111529829 | A | 8/2020 |
| CN | 111796680 | * | 10/2020 |
| CN | 111796680 | A | 10/2020 |
| CN | 111800134 | A | 10/2020 |
| CN | 112190248 | A | 1/2021 |
| CN | 113069089 | A | 7/2021 |
| CN | 113080890 | A | 7/2021 |
| CN | 113180606 | A | 7/2021 |
| CN | 113712517 | A | 11/2021 |
| EP | 3851029 | A1 | 7/2021 |
| KR | 20150082038 | A | 7/2015 |
| WO | 2018082211 | A1 | 5/2018 |
| WO | 2020150973 | A1 | 7/2020 |
| WO | 2021227386 | A1 | 11/2021 |

* cited by examiner

PHOTOPLETHYSMOGRAPHY (PPG) BASED CONTROL METHOD AND ELECTRONIC DEVICE

CROSS-REFERENCE TO RELATED APPLICATIONS

This application is a national stage of International Application No. PCT/CN2022/119362, filed on Sep. 16, 2022, which claims priority to Chinese Patent Application No. 202111649199.7, filed on Dec. 29, 2021. The disclosures of the aforementioned applications are hereby incorporated by reference in their entireties.

TECHNICAL FIELD

This application relates to the field of terminal technologies, and in particular, to a photoplethysmography (PPG) based control method and an electronic device.

BACKGROUND

At present, with the development of terminal technologies, terminal devices have become a part of people's work and life. In order to meet the needs of users for health management, many terminal devices can provide users with a human body data monitoring function. For example, a user can use an electronic device, such as a wearable device, to detect human body data. Specifically, for example, a device such as a smart watch or a smart bracelet is used to measure human body characteristics such as heart rate, respiratory rate, or blood oxygen of the user.

Typically, a wearable device may be equipped with a photoplethysmography (photo plethysmo photography, PPG) module for measurement of human body characteristics. The PPG module may include a photodiode (photo diode, PD) and a light-emitting diode (light emitting diode, LED). When the user uses the wearable device including the PPG module to monitor the human body characteristics, the LED in the PPG module can emit a light signal corresponding to a preset current value, and the PD can receive a light signal reflected by a human tissue. The PD converts the light signal into current data, so that the wearable device can obtain the human body characteristics based on calculation of the current data.

However, in some scenarios, the wearable device cannot obtain stable current data, and thus cannot obtain accurate human body characteristics based on the current data.

SUMMARY

Embodiments of this application provide a photoplethysmography (PPG) based control method and an electronic device. Based on a relationship between an actual current received by a PD and a target current, intensity of a current corresponding to a light signal emitted by a LED can be fed back and adjusted, so that the PD can obtain stable current data, and then the electronic device can obtain accurate human body characteristics by monitoring based on the stable current data.

According to a first aspect, an embodiment of this application provides a PPG-based control method, applied to an electronic device including a PPG module, the PPG module including a plurality of light-emitting diodes LEDs and a plurality of photodiodes PDs. The method includes: using, by the electronic device, the plurality of LEDs to emit a light signal corresponding to a first current; using, by the electronic device, at least one of the plurality of PDs to obtain a second current retumed by the light signal corresponding to the first current via a human tissue; and reducing, by the electronic device, the first current by using a preset first current step size when the electronic device determines that the second current is greater than a target current; or increasing, by the electronic device, the first current by using the preset first current step size when the electronic device determines that the second current is less than the target current. In this way, based on a relationship between an actual current received by a PD and a target current, the electronic device can feed back and adjust intensity of a current corresponding to a light signal emitted by a LED, so that the PD can obtain stable current data, and then the electronic device can obtain accurate human body characteristics by monitoring based on the stable current data. The target current may be a target received current described in the embodiments of this application.

In a possible implementation, the method further includes: determining, by the electronic device, a target scenario in which the electronic device is located, where the target scenario is one of a plurality of predefined scenarios, and any one of the scenarios corresponds to a received current for monitoring of human body characteristics using the PPG module; and determining, by the electronic device, a target current corresponding to the target scenario. In this way, the electronic device can prevent an extreme scenario from affecting the PPG module by setting target currents suitable for different scenarios, so that the current data obtained by the PD satisfies a stable value range, and the electronic device can obtain relatively accurate human body characteristics by monitoring in different scenarios.

In a possible implementation. the determining, by the electronic device, a target scenario in which the electronic device is located includes: obtaining, by the electronic device, first data, where the first data includes: acceleration data, angular acceleration data, barometric pressure data, and/or temperature data; and detecting, by the electronic device, the first data by using a preset rule to obtain the target scenario. In this way, the method for the electronic device to perform automatic scenario detection based on the obtained sensor data can avoid a user's triggering step during the scenario recognition, thereby improving algorithm availability.

In a possible implementation, the determining, by the electronic device, a target scenario in which the electronic device is located includes: receiving, by the electronic device, a first operation, where the first operation is used to set a monitoring scenario for monitoring of human body characteristics using the PPG module: and in response to the first operation, determining. by the electronic device, the target scenario in which the electronic device is located. In this way, the method for the electronic device to determine the workout scenario based on the user's triggering can avoid complex steps during workout scenario detection, thereby simplifying algorithm memory occupation.

In a possible implementation, the LED is a tricolor LED that produces red, green, and infrared light, and the obtaining a second current returned by the light signal corresponding to the first current via a human tissue includes: obtaining at least one fourth current returned by a light signal corresponding to at least one third current via the human tissue, where the at least one third current is emitted by at least one light source in the tricolor LED. In this way, the electronic device can obtain currents emitted by different LEDs, so that the electronic device can separately adjust the currents emitted by different LEDs, based on the received currents corresponding to different LEDs. In this way, the PD can obtain stable current data corresponding to different LEDs.

In a possible implementation, the method further includes: reducing, by the electronic device, the at least one third current by using the preset first current step size when the electronic device determines that the at least one fourth current is greater than a received current corresponding to the at least one light source in the tricolor LED; or increasing, by the electronic device, the at least one third current by using the preset first current step size when the electronic device determines that the at least one fourth current is less than the received current corresponding to the at least one light source in the tricolor LED. In this way, the electronic device can separately adjust the currents emitted by different LEDs, based on the received currents corresponding to different LEDs. In this way, the PD can obtain stable current data corresponding to different LEDs.

In a possible implementation, before the using, by the electronic device, the plurality of LEDs to emit a light signal corresponding to a first current, the method further includes: determining, by the electronic device, a target light sequence based on monitoring content and intensity of illumination in which the electronic device is located, where the target light sequence is used to indicate a light emission status of light sources in the LEDs for monitoring of human body characteristics using the PPG module, and the monitoring content includes: heart rate monitoring, blood oxygen monitoring, and/or respiratory rate monitoring; and the using, by the electronic device. the plurality of LEDs to emit a light signal corresponding to a first current includes: using, by the electronic device according to the target light sequence, the plurality of LEDs to emit the light signal corresponding to the first current. In this way, the electronic device can flexibly adjust the emitted light signal based on the monitoring content and the illumination intensity, thereby enhancing the intelligence of the electronic device.

In a possible implementation, the determining, by the electronic device, a target light sequence based on monitoring content and intensity of illumination in which the electronic device is located includes: determining, by the electronic device, that the target light sequence is that the LED satisfies green light emission, when the monitoring content is heart rate monitoring and the intensity of illumination in which the electronic device is located is greater than or equal to an illumination intensity threshold; or determining, by the electronic device, that the target light sequence is that the LED satisfies infrared light emission, when the monitoring content is heart rate monitoring and the intensity of illumination in which the electronic device is located is less than the illumination intensity threshold. In this way, the electronic device can emit different types of light signals under different monitoring contents and illumination intensities, thereby enhancing the accuracy of the monitoring of the human body characteristics by the electronic device.

In a possible implementation, before the using, by the electronic device, the plurality of LEDs to emit a light signal corresponding to a first current, the method further includes: receiving, by the electronic device, a second operation, where the second operation is used to indicate start of monitoring of human body characteristics; in response to the second operation, using, by the electronic device, the plurality of LEDs to emit a light signal corresponding to a fifth current; and using, by the electronic device, at least one of the plurality of PDs to obtain a sixth current returned by the light signal corresponding to the fifth current via the human tissue; and the using, by the electronic device, the plurality of LEDs to emit a light signal corresponding to a first current includes: using, by the electronic device, the plurality of LEDs to emit the light signal corresponding to the first current, when the electronic device determines that the sixth current satisfies a first preset current. In this way, the electronic device can perform wearing detection based on the sixth current, so as to prepare for the monitoring of the human body characteristics.

In a possible implementation, the method further includes: displaying, by the electronic device, first prompt information when the electronic device determines that the sixth current does not satisfy the first preset current, where the first prompt information is used to indicate that wearing of the electronic device has not been detected. In this way, the user can detect the wearing situation in a timely manner based on the prompt information displayed by the electronic device.

In a possible implementation, the method further includes: receiving, by the electronic device, a third operation, where the third operation is used to indicate end of monitoring of human body characteristics; and in response to the third operation, obtaining, by the electronic device, a result of the monitoring of human body characteristics based on the second current.

In a possible implementation, the electronic device includes a wearable device, and the wearable device includes one or more of the following: a smart watch, a smart bracelet, or smart glasses.

According to a second aspect, an embodiment of this application provides an electronic device, including a processor and a memory. The memory is configured to store code instructions. The processor is configured to run the code instructions to cause the electronic device to perform the PPG-based control method described in the first aspect or any one of the implementations of the first aspect.

According to a third aspect, an embodiment of this application provides a computer-readable storage medium. The computer-readable storage medium stores instructions, and when the instructions are executed, a computer is caused to perform the PPG-based control method described in the first aspect or any one of the implementations of the first aspect.

According to a fourth aspect, a computer program product including a computer program is provided. When the computer program is run, a computer is caused to perform the PPG-based control method described in the first aspect or any one of the implementations of the first aspect.

It should be understood that the second to fourth aspects of this application correspond to the technical solution according to the first aspect of this application, and the beneficial effects obtained from the aspects and the corresponding feasible implementations are similar and not to be repeated.

DESCRIPTION OF EMBODIMENTS

In order to clearly describe technical solutions in the embodiments of this application, the terms such as "first" and "second" are used in the embodiments of this application to distinguish the same or similar items having basically the same function and effect. For example, a first value and a second value are used only to distinguish different values, without limiting the order thereof. Those skilled in the art can understand that the terms "first", "second", and the like do not limit the number and execution order, and the terms "first", "second", and the like do not necessarily imply a difference.

It should be noted that in this application, the term such as "exemplary" or "for example" is used to represent giving an example, an illustration, or a description. Any embodiment or design described by "exemplary" or "for example" in this application should not be construed as being preferred or more advantageous over other embodiments or designs. To be precise, the use of the term such as "exemplary" or "for example" is intended to present a related concept in a specific manner.

In this application, "at least one" means one or more, and "a plurality of" means two or more. The term "and/or" describes an association relationship between associated objects, and indicates that three relationships may be present. For example, A and/or B may indicate the presence of only A, both A and B, and only B, where A and B may be singular or plural. The character "/" generally indicates an "or" relationship between the associated objects. "At least one of the following" or similar expressions refer to any combination of these items, including any combination of single items or a plurality of items. For example, at least one of a, b, or c may represent: a, b, c, a and b, a and c, b and c, or a, b, and c, where a, b, or c may be singular or plural.

At present, with the development of terminal technologies, terminal devices have become a part of people's work and life. In order to meet the needs of users for health management, many terminal devices can provide users with a human body data monitoring function. For example, a user can use an electronic device. for example, a wearable device such as a smart watch, to measure human body characteristics such as heart rate, respiratory rate, or blood oxygen, so that the user can grasp the physical condition in real time based on the human body characteristics monitored in the smart watch.

Figure 1:
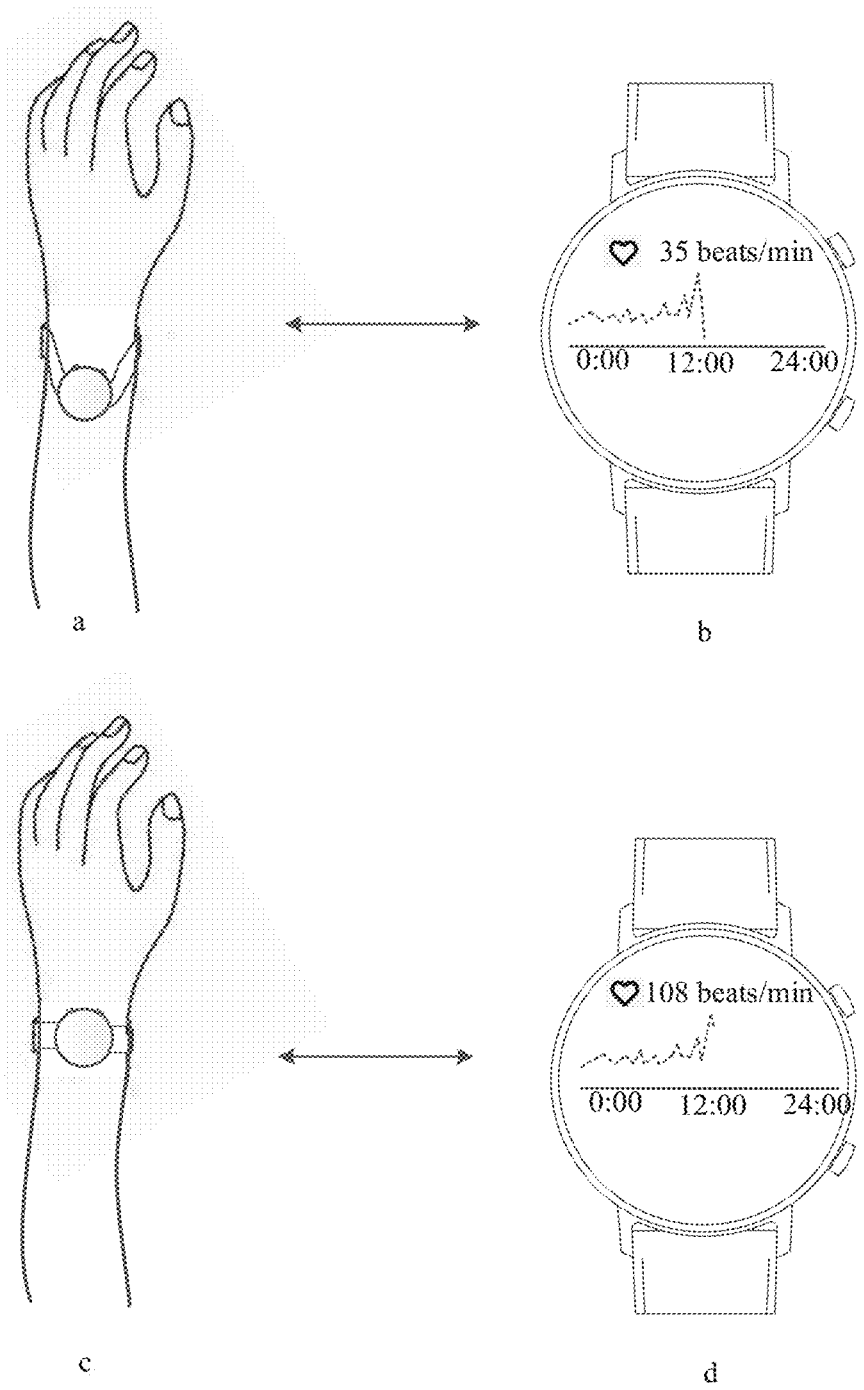
FIG. 1 is a schematic diagram of a scenario according to an embodiment of this application.

For example, FIG. 1 is a schematic diagram of a scenario according to an embodiment of this application. It can be understood that, this embodiment of this application is illustrated with an example in which an electronic device is a smart watch among wearable devices, and this example does not constitute a limitation on the embodiments of this application.

It can be understood that the electronic device may include: a mobile phone (mobile phone), a smart television, a wearable device, a tablet computer (Pad), a computer having a wireless sending and receiving function, a virtual reality (virtual reality, VR) terminal device, an augmented reality (augmented reality, AR) device, a wireless device in industrial control (industrial control), or a wireless device in self-driving (self-driving). The wearable device may include: a smart watch, a smart bracelet, smart gloves, smart glasses, a virtual reality (virtual reality, VR) terminal device, a smart waist belt, or another device. Specific forms of the electronic device and the wearable device are not specifically limited in the embodiments of this application.

As shown in FIG. 1, a user can use a wearable device, such as a smart watch, to measure the user's body characteristics during an exercise. For example, the user can use the smart watch to measure the heart rate, and then the user can adjust the exercise intensity based on heart rate data displayed on the smart watch. Alternatively, the smart watch can analyze the monitored heart rate data of the user, and then provide the user with more reasonable exercise suggestions to help the user exercise more efficiently.

For example, when the user wears the smart watch to monitor the heart rate during an exercise, repeated swinging of the user's arm during the exercise may change the position of the strap of the smart watch or loosen the strap of the smart watch, as shown in a in FIG. 1. When the user wears the smart watch in an improper position, the smart watch may detect a heart rate monitoring result of 35 beats/min, as shown in b in FIG. 1. The heart rate monitoring result in this case is much lower than the normal value.

When the user, as shown in c in FIG. 1, wears the smart watch properly during an exercise, the smart watch may detect a heart rate monitoring result of 108 beats/min, as shown in d in FIG. 1. The heart rate monitoring result in this case is normal.

Figure 2:
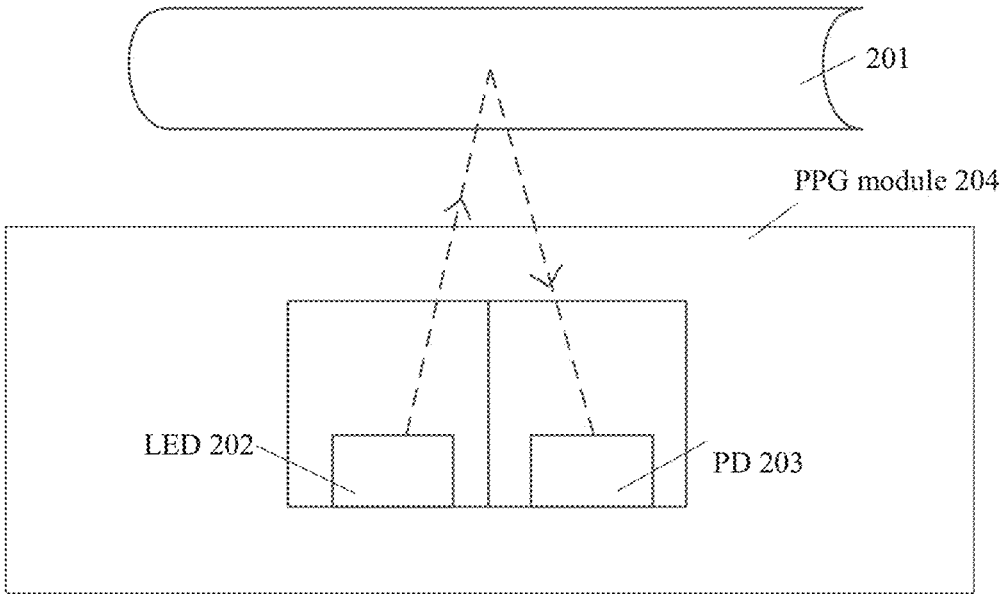
FIG. 2 is a schematic diagram of a principle of measuring human body characteristics based on a PPG module according to an embodiment of this application.

Typically, a wearable device can monitor human body characteristics based on a PPG module in the device. For example, FIG. 2 is a schematic diagram of a principle of measuring human body characteristics based on a PPG module according to an embodiment of this application. PPG can be understood as a detection method for optically detecting blood volume changes in a tissue of a living organism. As shown in FIG. 2, the PPG module 204 may include at least one PD, for example, PD 203, and at least one LED, for example, LED 202.

In the embodiment corresponding to FIG. 2, the wearable device can use the LED 202 in the PPG module 204 to emit a light signal corresponding to a preset current value. A skin tissue (or rather, blood, blood vessels, or the like in the skin tissue) 201 is illuminated with the light signal. The PD 203 is used to receive a light signal reflected by the skin tissue 201. The PD 203 converts the light signal into an electrical signal, which undergoes an analog-to-digital conversion (analogue to digital conversion, A/D) to be converted into a digital signal (or referred to as a PPG signal) usable by the wearable device. The human body characteristics are then calculated based on the PPG signal, thereby implementing the measurement of the human body characteristics by the wearable device.

In the workout scenario shown in a in FIG. 1, as the wearable device shakes along with the movement of the user's body, the wearing position and tightness of the wearable device change, and the PPG module 204 in the wearable device moves relative to the skin tissue 201, which affects a light signal reflected by the skin tissue 201. As a result, the PD 203 in the PPG module 204 cannot obtain accurate current data based on the light signal, and then the wearable device cannot obtain effective human body data based on the current data.

It can be understood that when the user uses the wearable device to monitor the human body characteristics, the wearing position or tightness of the wearable device may affect the strength of the PPG signal detected by the wearable device, causing an inaccuracy, jump, or the like in the human body monitoring result calculated based on the PPG signal, which affects the user experience when using the wearable device to monitor human body characteristics.

In a possible implementation, the user's skin color and hair coverage may also affect the PPG signal. It can be understood that the factors affecting the obtaining of the PPG signal by the wearable device may include other contents depending on actual scenarios, which is not specifically limited in the embodiments of this application.

In view of this, an embodiment of this application provides a PPG-based control method. Therefore, based on a relationship between an actual current received by a PD and a target received current, a wearable device can feed back and adjust intensity of a current corresponding to a light signal emitted by a LED, so that the PD can obtain stable current data, and then the wearable device can obtain accurate human body characteristics by monitoring based on the stable current data.

In this embodiment of this application, the wearable device includes a PPG module. The PPG module may include at least one PD and at least one LED. The LED may be a tricolor LED that produces red, green, and infrared light. The PPG module described in this embodiment of this application may include two LEDs and eight PDs.

Figure 3:
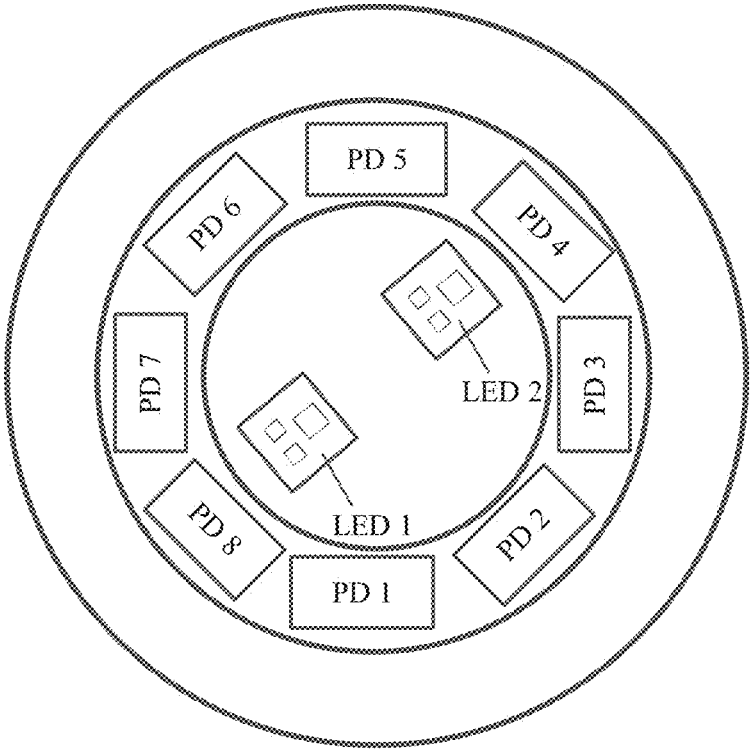
FIG. 3 is a schematic structural diagram of a PPG module based on 2LED+8PD according to an embodiment of this application.

For example, FIG. 3 is a schematic structural diagram of a PPG module based on 2LED+8PD according to an embodiment of this application. As shown in FIG. 3, the wearable device may be provided with a PPG module having a circular structure, and the PPG module having the circular structure may include: two tricolor LEDs and eight PDs. Specifically, the two tricolor LEDs are provided in the innermost part of the PPG module, and the two tricolor LEDs can both be used to emit a light signal, such as red, green, and infrared light. The eight PDs in an encircling structure are provided on the outer side of the two tricolor LEDs. As shown in FIG. 3, the two tricolor LEDs may include: LED 1 and LED 2. The eight PDs in the encircling structure may include: PD 1, PD 2, PD 3, PD 4, PD 5, PD 6, PD 7, and PD 8.

Specifically, during monitoring of human body characteristics by using the PPG module based on 2LED+8PD, at least one of the two LEDs may emit a light signal based on a preset current, and at least one of the eight PDs may obtain current data corresponding to a light signal reflected by a skin tissue, so that the wearable device can obtain a result of the monitoring of the human body characteristics based on the current data obtained by the at least one of the eight PDs.

It can be understood that during the monitoring of the human body characteristics, the wearable device may use one of the eight PDs to obtain the current data, or may use a pair of PDs (for example, two PDs) among the eight PDs to obtain the current data, or may use all the eight PDs to obtain the current data, which is not limited in this embodiment of this application.

Figure 4:
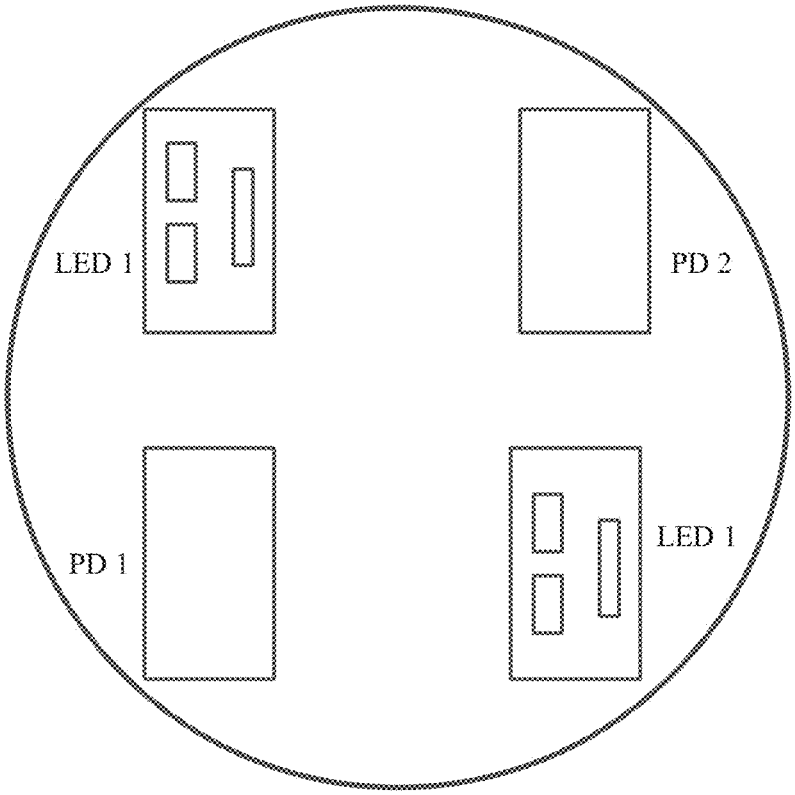
FIG. 4 is a schematic structural diagram of a PPG module based on 2LED+2PD according to an embodiment of this application.

In a possible implementation, alternatively, the PPG module may include two LEDs and two PDs. For example, FIG. 4 is a schematic structural diagram of a PPG module based on 2LED+2PD according to an embodiment of this application. As shown in FIG. 4, the wearable device may be provided with the PPG module having a circular structure. and the PPG module having the circular structure may include: two tricolor LEDs, for example, LED 1 and LED 2, and two PDs, for example, PD 1 and PD 2. The two tricolor LEDs and the two PDs are spaced in the circular structure of the PPG module. The tricolor LED may emit red, green, and infrared light.

Specifically, during monitoring of human body characteristics by using the PPG module based on 2LED+2PD, at least one of the two LEDs emits a light signal based on a preset current, and at least one of the two PDs may obtain current data corresponding to a light signal emitted by the LED and reflected by a skin tissue, so that the wearable device can obtain a result of the monitoring of the human body characteristics based on the current data obtained by the at least one of the two PDs.

Figure 5:
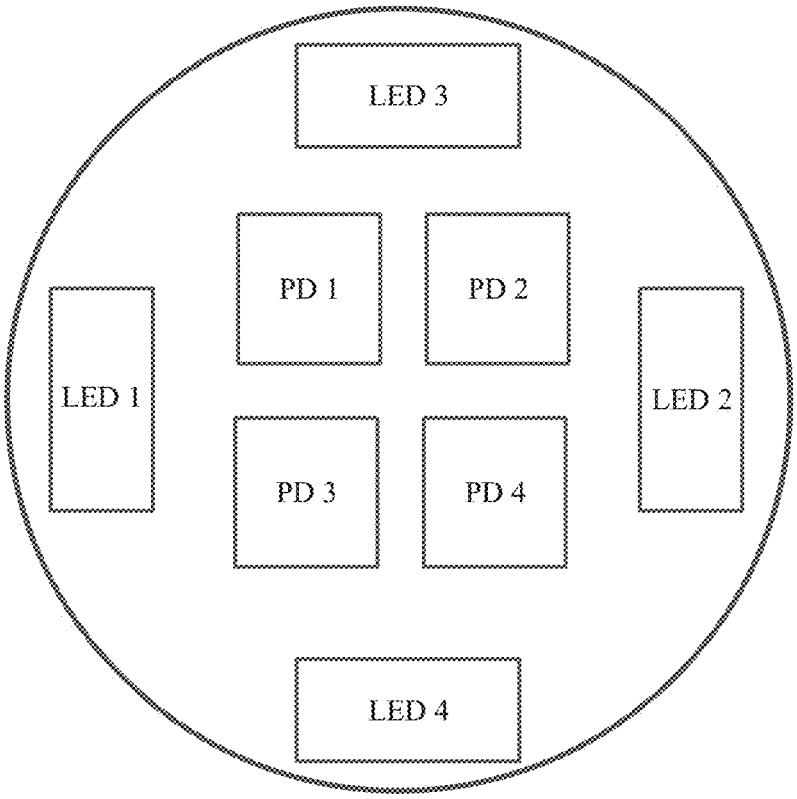
FIG. 5 is a schematic structural diagram of a PPG module based on 4LED+4PD according to an embodiment of this application.

In a possible implementation, alternatively, the PPG module may include four LEDs and four PDs. For example, FIG. 5 is a schematic structural diagram of a PPG module based on 4LED+4PD according to an embodiment of this application. As shown in FIG. 5, the wearable device may be provided with a PPG module having a circular structure, and the PPG module may include: four LEDs, for example LED, LED 2, LED 3, and LED 4, and four PDs, for example, PD 1, PD 2, PD 3, and PD 4. The four LEDs exhibits an encircling structure, and the four PDs are provided on the inner side of the four LEDs. The four LEDs are in a symmetrical structure in the PPG module, and the four PDs may also be in a symmetrical structure in the PPG module. The four LEDs may all be tricolor LEDs, or any one of the four LEDs may be configured to emit only one light source.

Specifically, during monitoring of human body characteristics by using the PPG module based on 4LED+4PD, at least one of the four LEDs provided on the outer side of the PDs may emit a light signal based on a preset current, and at least one of the four PDs may obtain current data corresponding to a light signal emitted by the LED on the outer side and reflected by a skin tissue, so that the wearable device can obtain a result of the monitoring of the human body characteristics based on the current data obtained by the at least one of the four PDs.

It can be understood that the PPG module in the embodiments of this application may have a circular structure or a square structure, and the form of the PPG module is not limited in the embodiments of this application.

It can be understood that the number and form of the LEDs, and the number and form of the PDs in the PPG module are not limited in the embodiments of this application.

It can be understood that the wearable device in this embodiment of this application may include: a smart watch, a smart bracelet, smart gloves, a smart waist belt, or another device. A specific technology and specific device form used by the wearable device are not limited in the embodiments of this application.

Figure 6:
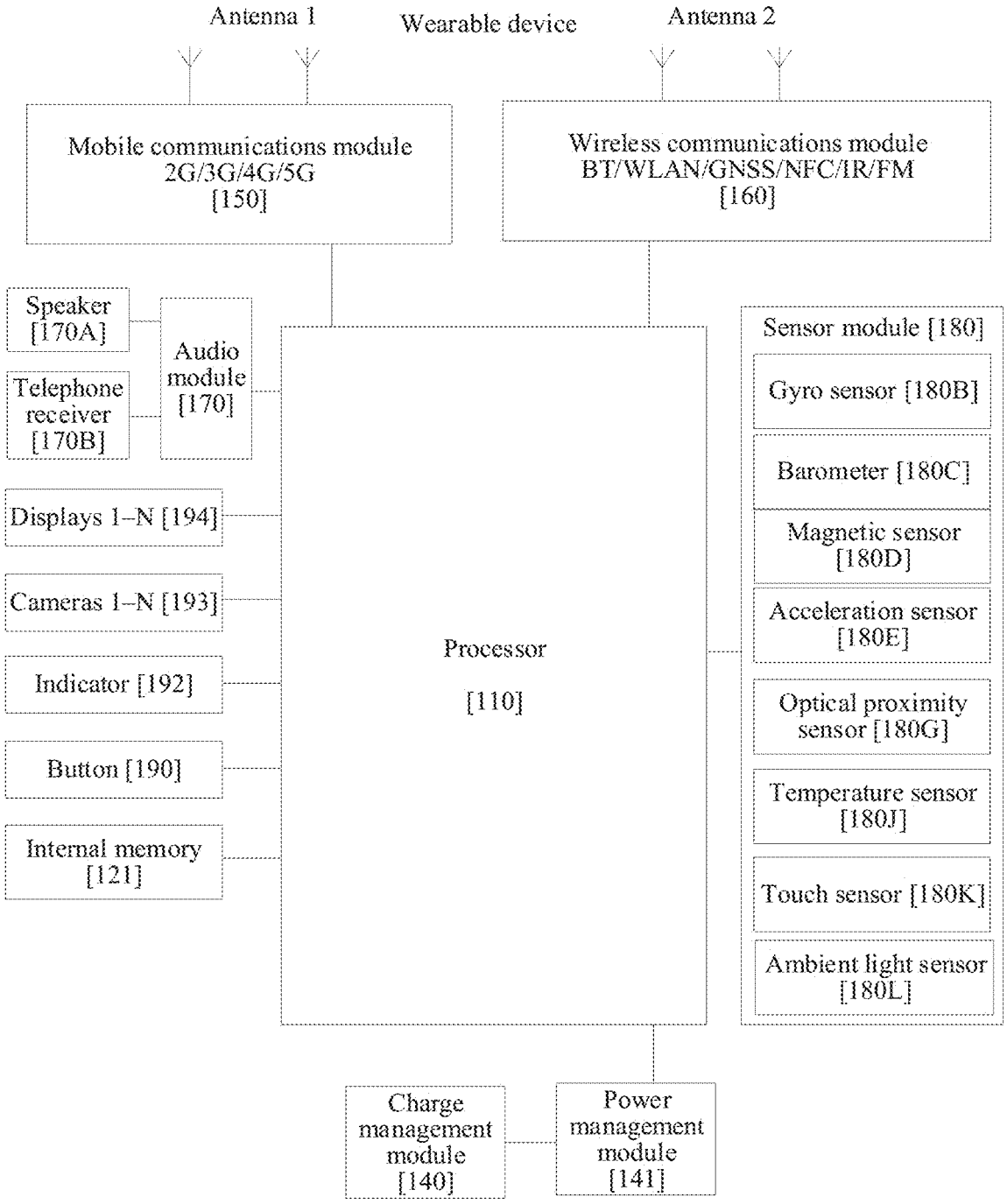
FIG. 6 is a schematic structural diagram of a wearable device according to an embodiment of this application.

For a better understanding of the embodiments of this application, the structure of the wearable device in the embodiments of this application is described below. For example, FIG. 6 is a schematic structural diagram of a wearable device according to an embodiment of this application.

The wearable device may include a processor 110, an internal memory 121, a universal serial bus (universal serial bus, USB) interface, a charge management module 140, a power management module 141, an antenna 1, an antenna 2, a mobile communications module 150, a wireless communications module 160, an audio module 170, a speaker 170A, a telephone receiver 170B, a sensor module 180, a button 190, an indicator 192, a camera 193, a display 194, and the like. The sensor module 180 may include: a gyro sensor 180B, a barometer 180C, a magnetic sensor 180D, an acceleration sensor 180E, an optical proximity sensor 180G, a temperature sensor 180J, a touch sensor 180K, an ambient light sensor 180L, and the like.

It can be understood that the structure illustrated in this embodiment of this application does not constitute a specific limitation on the wearable device. In some other embodiments of this application, the wearable device may include more or fewer components than those shown in the figure, or may have some components combined or split, or may have a different arrangement of the components. The illustrated components may be implemented by hardware, software, or a combination of software and hardware.

The processor 110 may include one or more processing units. Different processing units may be separate components, or may be integrated into one or more processors. The processor 110 may further be provided with a memory for storing instructions and data.

The charge management module 140 is configured to receive a charging input from a charger. The charger may be a wireless charger or a wired charger. The power management module 141 is configured to connect the charge management module 140 and the processor 110.

A wireless communication function of the wearable device may be implemented by using the antenna 1, the antenna 2, the mobile communications module 150, the wireless communications module 160, a modem processor, a baseband processor, and the like.

The antenna 1 and the antenna 2 are configured to transmit and receive electromagnetic wave signals. The antenna in the wearable device may be configured to cover one or more communications frequency bands. Different antennas may further support multiplexing so as to increase antenna utilization.

The mobile communications module 150 may provide wireless communication solutions including 2G, 3G, 4G, 5G, and the like which are applied to the wearable device. The mobile communications module 150 may include at least one filter, switch, power amplifier, low noise amplifier (low noise amplifier, LNA), and the like. The mobile communications module 150 may receive an electromagnetic wave from the antenna 1, perform filtering, amplification, and other processing on the received electromagnetic wave, and then transmit the electromagnetic wave to the modem processor for demodulation.

The wireless communications module 160 may provide wireless communication solutions applied to the wearable device, including wireless local area network (wireless local area networks, WLAN) (for example, wireless fidelity (wireless fidelity, Wi-Fi) network), Bluetooth (bluetooth, BT), global navigation satellite system (global navigation satellite system, GNSS), frequency modulation (frequency modulation, FM), and the like.

The wearable device implements a display function by using a GPU, the display 194, an application processor, and the like. The GPU is a microprocessor for image processing and is connected to the display 194 and the application processor. The GPU is configured to perform mathematical and geometric computation for graphic rendering.

The display 194 is configured to display images, videos, or the like. The display 194 includes a display panel. In some embodiments, the wearable device may include one or N displays 194, where N is a positive integer greater than 1.

The wearable device may implement a shooting function by using an ISP, the camera 193, a video codec, the GPU, the display 194, the application processor, and the like.

The camera 193 is configured to capture a static image or a video. In some embodiments, the wearable device may include one or N cameras 193, where N is a positive integer greater than 1.

The internal memory 121 may be configured to store computer-executable program code which includes instructions. The internal memory 121 may include a program storage area and a data storage area.

The wearable device may implement an audio function, such as music playback or recording, by using the audio module 170, the speaker 170A, the telephone receiver 170B, the application processor, and the like.

The audio module 170 is configured to convert digital audio information into an analog audio signal output, and also configured to convert an analog audio input into a digital audio signal. The speaker 170A, also referred to as a "loudspeaker", is configured to convert an audio electrical signal into a sound signal. The wearable device may be used for listening to music or answering a hands-free call by using the speaker 170A. The telephone receiver 170B, also referred to as an "earpiece", is configured to convert an audio electrical signal into a sound signal. When a call or a voice message is answered on the wearable device, the telephone receiver 170B may be placed near the human ear to receive the voice.

The gyro sensor 180B may be configured to determine a motion posture of the wearable device. The magnetic sensor 180D includes a Hall sensor.

The barometer 180C is configured to measure barometric pressure. In some embodiments, the wearable device may calculate an altitude based on a barometric pressure value measured by the barometer 180C, to assist in positioning and navigation. In this embodiment of this application, the barometer 180C is configured to measure barometric pressure to which the wearable device is subjected. For example, the barometer 180C may be configured to detect whether the wearable device is underwater.

The acceleration sensor 180E may detect accelerations of the wearable device in various directions (generally three axes). In this embodiment of this application, the acceleration sensor 180E is configured to detect whether the wearable device is in a motion state.

The optical proximity sensor 180G may be configured to detect whether an object approaches or moves away from the wearable device. The ambient light sensor 180L is configured to sense luminance of ambient light. The temperature sensor 180J is configured to measure temperature. In this embodiment of this application, the temperature sensor is configured to detect temperature of an environment in which the wearable device is located.

The touch sensor 180K is also referred to as a "touch component". The touch sensor 180K may be provided in the display 194, and the touch sensor 180K and the display 194 form a touchscreen, which is also referred to as a "touchscreen".

The button 190 includes a power button, a volume button, and the like. The button 190 may be a mechanical button, or may be a touch button. The wearable device may receive a button input, and generate a button signal input related to user settings and function control of the wearable device. The indicator 192 may be an indicator light, which may be configured to indicate a charging status and battery level changes, and may also be configured to indicate messages, missed calls, notifications, and the like.

A software system of the wearable device may use a layered architecture, an event-driven architecture, a microkernel architecture, a microservice architecture, a cloud architecture, or the like. An embodiment of this application takes a system with a layered architecture as an example to illustratively describe a software structure of the wearable device.

Figure 7:
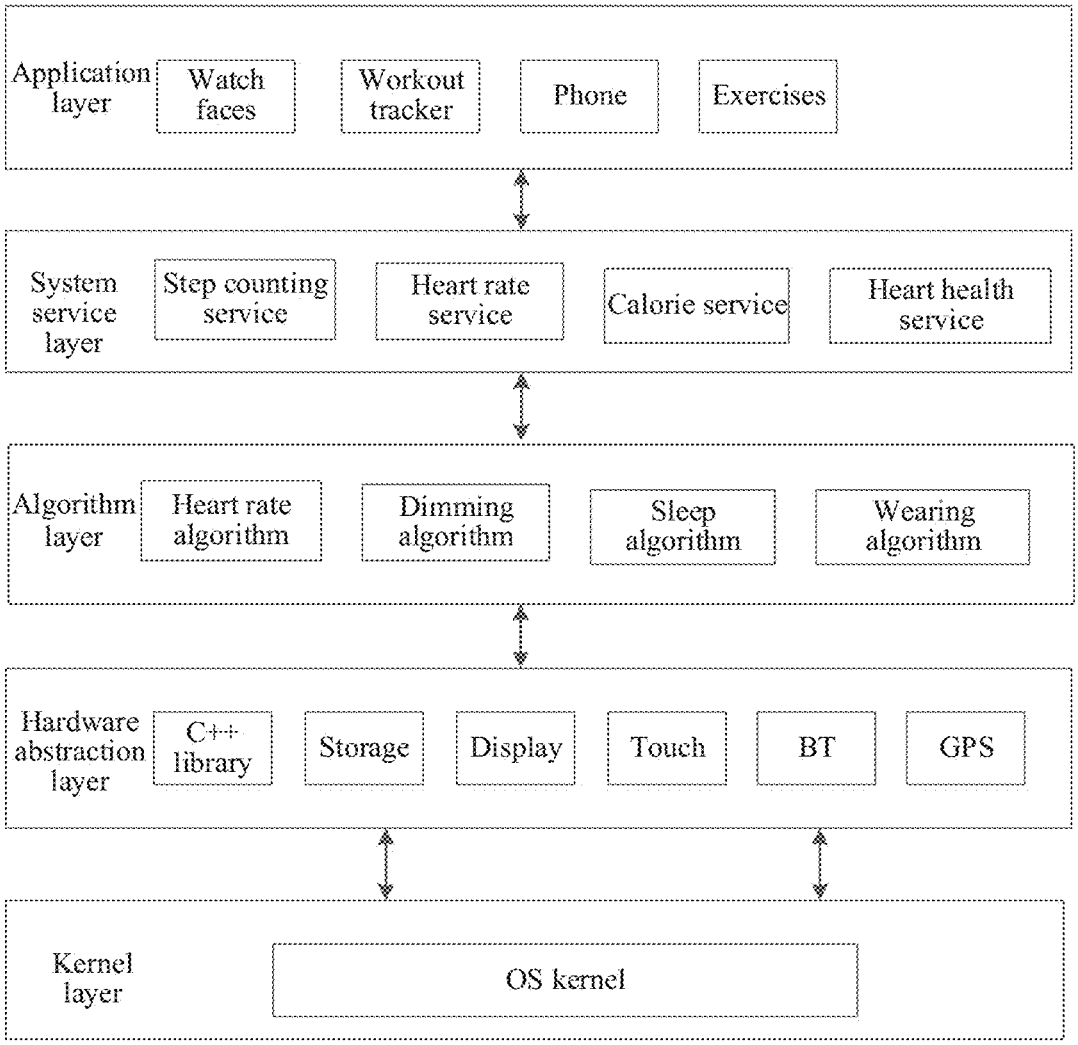
FIG. 7 is a schematic diagram of a software structure of a smart watch according to an embodiment of this application.

For example, the wearable device is a smart watch. FIG. 7 is a schematic diagram of a software structure of a smart watch according to an embodiment of this application.

As shown in FIG. 7, the layered architecture divides software into several layers, and each layer has a clear role and responsibility. The layers communicate with each other through a software interface. In some embodiments, the software architecture of the smart watch may be divided into five layers, which, from top to bottom, are respectively: an application (application, APP) layer, a system service layer, an algorithm layer, a hardware abstraction layer (hardware abstraction layer, HAL), and a kernel (kernel) layer.

The application layer may include a series of application programs. For example, the application programs may include: a watch faces application, a workout tracker application, a phone application, a workout application, and the like.

The system service layer is used to provide system support for the application programs in the application layer. For example, the system service layer may include: a step counting service, a heart rate service, a calorie service, a heart health service, and other modules.

The algorithm layer is used to provide algorithm support for the system service layer. For example, the algorithm layer may include: a heart rate algorithm, a dimming algorithm, a sleep algorithm, a wearing algorithm, and the like. In the embodiments of this application, the heart rate algorithm, the dimming algorithm, the sleep algorithm, and the wearing algorithm may be jointly used to support the heart rate service, so as to monitor heart rate characteristics of a user under different states.

In this embodiment of this application, the heart rate algorithm is used to convert the current data obtained by the PD in the PPG module into heart rate data; the dimming algorithm is used to feed back and adjust a current value corresponding to a light signal emitted by the LED, based on a current value obtained by the PD during monitoring of human body characteristics; the sleep algorithm is used to adjust a light emission status of the LEDs in the PPG module based on a sleep state; and the wearing algorithm is used to detect whether the user is currently wearing the smart watch properly, based on the current data obtained by the PD.

In the hardware abstraction layer, all hardware-related operations required by an upper layer of the system need to call a HAL-related application programming interface (application programming interface, API). Some functions are specified in a software architecture layer of each hardware device, and the HAL layer may be used to implement these functions.

The hardware abstraction layer may include: an interface corresponding to a C++ library, a storage interface, a display interface, a touch interface, a bluetooth (bluetooth) interface, a global positioning system (global positioning system, GPS) interface, and the like.

The kernel layer may be a layer between hardware and software. A kernel is system software that provides the hardware abstraction layer, disk and file system control, multitasking, and other functions. The kernel is the core of an operating system and the most fundamental part of the operating system. The kernel is responsible for managing the system's processes, memory, device drivers, files, network systems, and the like, and determines the performance and stability of the system. The kernel is a part of software that provides many application programs with secure access to computer hardware. Such access is limited, and the kernel determines when and how long a program operates a part of hardware.

The kernel layer may be an operating system kernel (operating system kernel, OS kernel).

The technical solutions of this application and how the technical solutions of this application resolve the foregoing technical problems are described in detail below with specific embodiments. The following several specific embodiments may be implemented separately, or may be combined with each other, and the same or similar concepts or processes may not be repeated in some embodiments.

Figure 8:
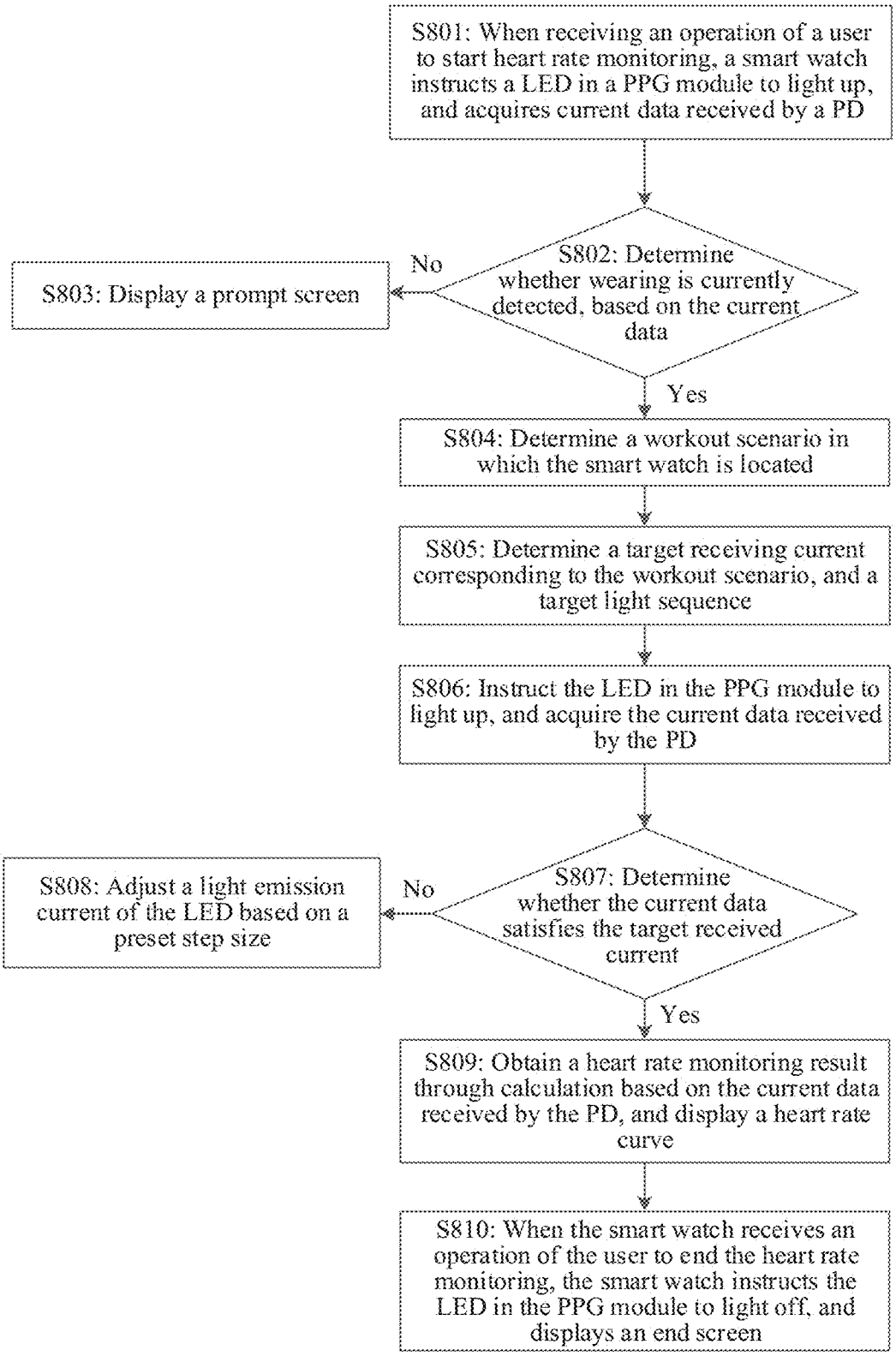
FIG. 8 is a schematic flowchart of a PPG-based control method according to an embodiment of this application.

For example, FIG. 8 is a schematic flowchart of a PPG-based control method according to an embodiment of this application. The embodiment corresponding to FIG. 8 is illustrated with an example in which an electronic device is a smart watch, among wearable devices, provided with a PPG module, and this example does not constitute a limitation on the embodiments of this application. The PPG module may be provided with two LEDs and eight PDs. The LED may be a tricolor LED. For the structure of the PPG module, refer to FIG. 3, which is not repeated herein.

As shown in FIG. 8, the PPG-based control method may include the following steps.

S801: When the smart watch receives an operation of a user to start heart rate monitoring, the smart watch instructs a LED in the PPG module to light up, and acquires current data received by a PD.

In this embodiment of this application, the operation of starting heart rate monitoring may be a trigger operation for a heart rate monitoring function in the smart watch, or may be a trigger operation for any workout mode in the smart watch. It can be understood that when the user starts any workout mode in the smart watch, the smart watch may enable the heart rate monitoring function by default to monitor the user's heart rate during an exercise.

Figure 9:
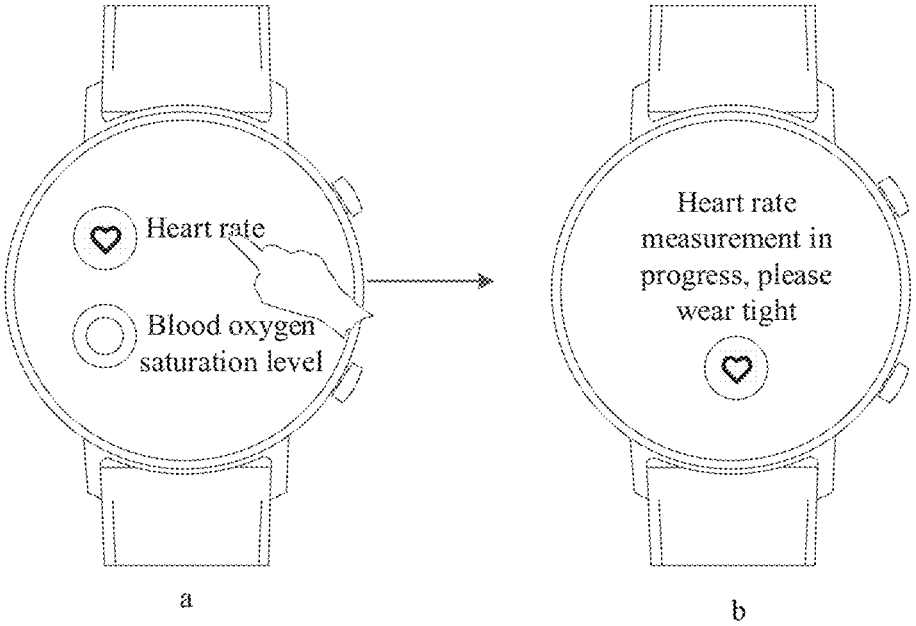
FIG. 9 is a schematic diagram of screens of starting heart rate monitoring according to an embodiment of this application.

For example, FIG. 9 is a schematic diagram of screens of starting heart rate monitoring according to an embodiment of this application. A screen shown by a in FIG. 9 may include a heart rate control for heart rate monitoring, a blood oxygen saturation level control for blood oxygen monitoring, and the like.

When the smart watch receives an operation of the user to trigger the heart rate control in the screen shown by a in FIG. 9, the smart watch may display a screen shown by b in FIG. 9. The screen shown by b in FIG. 9 may display a sign of heart rate monitoring being in progress and prompt information. The prompt information may be used to indicate wearing detection being in progress. For example, the prompt information may be: Heart rate monitoring in progress, please wear tight.

Correspondingly, during the wearing detection, the smart watch may instruct at least one LED in the PPG module to light up, and acquire current data received by at least one PD.

S802: The smart watch determines whether wearing is currently detected, based on the current data received by the PD.

For example, the smart watch may determine whether the wearing is currently detected, based on the current data received by the PD and preset current data (or current range) for the wearing detection. For example, when the smart watch determines that the current data received by the PD is greater than (or greater than or equal to) the preset current data for the wearing detection (or the received current data satisfies the current range), the smart watch may determine that the user's wearing is detected. Alternatively, when the smart watch determines that the current data received by the PD is less than or equal to (or less than) the preset current data for the wearing detection (or the received current data does not satisfy the current range), the smart watch may determine that the user's wearing fails to be detected.

Optionally, in this step, determining whether the wearing is currently detected may also be determining whether the smart watch is being wom by an organism with living characteristics. Optionally, liveness detection is used to determine whether the smart watch is being worn by an organism with living characteristics. In a possible implementation, the smart watch determines whether the smart watch has detected the wearing, based on a liveness detection method. The liveness detection is used to detect whether the smart watch is being wom by an organism with living characteristics. For example, the liveness detection method may include: infrared image liveness detection, 3D structured light liveness detection, red green blue (red green blue, RGB) image liveness detection, or the like, which is not limited in the embodiments of this application.

In this embodiment of this application, when the smart watch determines, based on the current data received by PD, that the wearing is currently detected, the smart watch may perform a step shown in S804; or when the smart watch determines, based on the current data received by the PD, that the wearing fails to be detected currently, the smart watch may perform a step shown in S803.

S803: The smart watch displays a prompt screen.

In this embodiment of this application, the prompt screen may include prompt information. The prompt information is used to indicate that wearing has not been detected.

Figure 10:
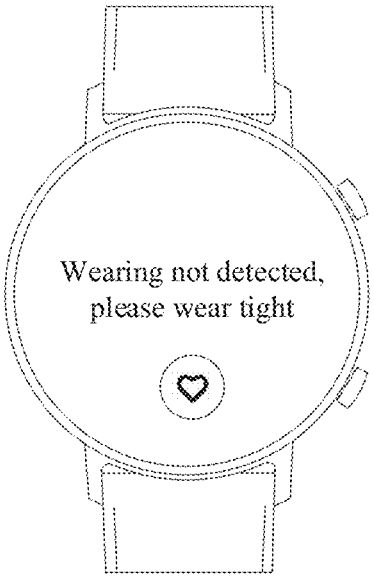
FIG. 10 is a schematic diagram of a prompt screen according to an embodiment of this application.

For example, FIG. 10 is a schematic diagram of a prompt screen according to an embodiment of this application. When the smart watch fails to detect wearing, the smart watch may display a screen shown in FIG. 10. The screen may display a sign of heart rate monitoring being in progress and prompt information. For example, the prompt information may be: Wearing not detected, please wear tight.

S804: The smart watch determines a workout scenario in which the smart watch is located.

In this embodiment of this application, the workout scenario may include one or more of the following, for example: a common workout scenario, an underwater workout scenario, or a low-temperature workout scenario.

In this embodiment of this application, the smart watch may perform workout scenario detection based on the following two methods. Method 1: The smart watch may perform automatic scenario detection based on the acceleration sensor, the gyro sensor, the barometer, the temperature sensor, and/or the like, so as to determine the workout scenario. Method 2: The smart watch may determine the workout scenario based on the user's triggering of any one of the plurality of workout modes supported by the smart watch.

Method 1: The smart watch may perform automatic scenario detection based on the acceleration sensor, the gyro sensor, the barometer, the temperature sensor, and/or the like, so as to determine the workout scenario.

For the common workout scenario, when the smart watch detects that an acceleration of the smart watch is greater than (or greater than or equal to) a preset acceleration threshold based on the acceleration sensor, and/or detects that an angular acceleration of the smart watch is greater than (or greater than or equal to) a preset angular acceleration threshold based on the gyro sensor, the smart watch may determine that the common workout scenario is currently satisfied.

For the underwater workout scenario, when the smart watch detects that an acceleration of the smart watch is greater than (or greater than or equal to) the preset acceleration threshold based on the acceleration sensor (and/or detects that an angular acceleration of the smart watch is greater than (or greater than or equal to) the preset angular acceleration threshold based on the gyro sensor), and detects that a barometric pressure of the smart watch is greater than (or greater than or equal to) a preset barometric pressure threshold based on the barometer, the smart watch may determine that the underwater workout scenario is currently satisfied.

For the low-temperature workout scenario, when the smart watch detects that an acceleration of the smart watch is greater than (or greater than or equal to) the preset acceleration threshold based on the acceleration sensor (and/or detects that an angular acceleration of the smart watch is greater than (or greater than or equal to) the preset angular acceleration threshold based on the gyro sensor), and detects that a temperature of the smart watch is less than (or less than or equal to) a preset temperature threshold based on the temperature sensor, the smart watch may determine that the low-temperature workout scenario is currently satisfied.

It can be understood that the preset acceleration threshold, the preset angular acceleration threshold, the preset barometric pressure threshold, and the preset temperature threshold may all be preset threshold ranges, which is not limited in the embodiments of this application.

It can be understood that the method for the smart watch to perform automatic scenario detection based on the obtained sensor data can avoid a user's triggering step during the scenario detection, thereby improving algorithm availability.

Method 2: The smart watch may determine the workout scenario based on the user's triggering of any one of the plurality of workout modes supported by the smart watch.

Figure 11:
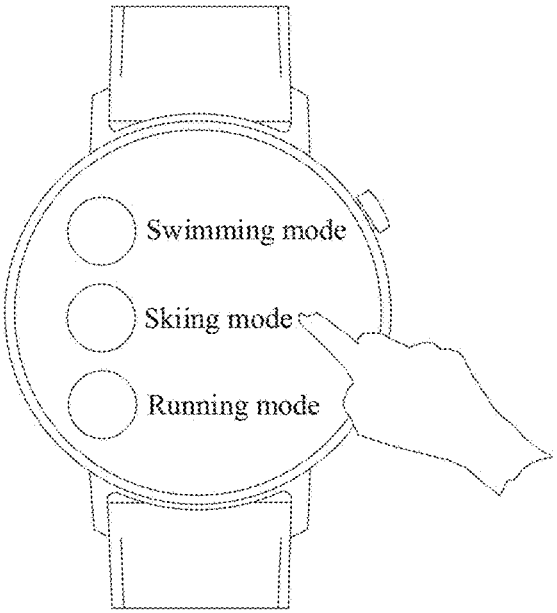
FIG. 11 is a schematic diagram of a screen of workout modes according to an embodiment of this application.

In the embodiments of this application, the smart watch may support a plurality of workout modes: underwater exercises such as a swimming mode (or the underwater workout scenario is satisfied), low-temperature exercises such as a skiing mode (or the low-temperature workout scenario is satisfied), and common exercises such as a walking mode, a running mode, and a cycling mode (or the common workout scenario is satisfied). For example, FIG. 11 is a schematic diagram of a screen of workout modes according to an embodiment of this application. As shown in FIG. 11, the screen may include: a swimming mode, a skiing mode, and a running mode. When the smart watch receives the user's operation to trigger a control corresponding to the skiing mode, the smart watch may determine that the low-temperature workout scenario is currently satisfied.

It can be understood that, as shown in FIG. 11, when the smart watch receives the user's triggering of any one of the above-mentioned workout modes, the smart watch may determine the current workout scenario.

It can be understood that the method for the smart watch to determine the workout scenario based on the user's triggering can avoid complex steps in workout scenario detection, thereby simplifying algorithm memory occupation.

It can be understood that the types of the workout scenarios and the method for detecting the workout scenarios may include other content depending on actual scenarios, which is not limited in the embodiments of this application.

S805: The smart watch determines a target received current corresponding to the workout scenario, and a target light sequence.

In the embodiments of this application, the target light sequence is used to indicate a light emission status (such as the number of LEDs required to emit the light source, and the type of the light source) of light sources in the LEDs for monitoring of human body characteristics using the PPG module. For example, the target light sequence may be related to monitoring content of the human body characteristics and intensity of illumination in which the smart watch is located. For example, the monitoring content of the human body characteristics may include: heart rate monitoring, blood oxygen monitoring, and/or respiratory rate monitoring, which is not limited in the embodiments of this application.

For example, when the smart watch determines that the monitoring content is heart rate monitoring, and the smart watch detects that ambient light is greater than (or greater than or equal to) an illumination threshold based on the ambient light sensor, the smart watch may control the LED to emit a green light signal. Alternatively, when the smart watch determines that the monitoring content is heart rate monitoring, and the smart watch detects that the ambient light is less than or equal to (or less than) the illumination threshold based on the ambient light sensor, the smart watch may control the LED to emit an infrared light signal.

It can be understood that the light emission status for the LED light source corresponding to different monitoring contents may include other contents depending on actual scenarios. which is not limited in the embodiments of this application.

In the embodiments of this application, the target received current is used to indicate a current value with which a result of the human body monitoring can be stably obtained in different scenarios. A correspondence between the workout scenario and the target received current may be preset in the smart watch.

For example, when the smart watch detects that the smart watch is currently in a low-temperature workout scenario, a target received current corresponding to the low-temperature workout scenario can be obtained, for example, 4 μA (microamps). Alternatively, when the smart watch detects that the smart watch is currently in a common workout scenario. a target received current corresponding to the common workout scenario can be obtained, for example, 1 μA.

It can be understood that, due to impact of workout scenarios, especially extreme environments such as low-temperature workout and/or underwater workout scenarios on a hardware module such as the PPG module, the current data obtained by the PD is often less than (or greater than) that obtained in the common workout mode, and therefore the smart watch cannot obtain an accurate monitoring result of the human body characteristics through calculation based on the current data from the PD. Therefore, the smart watch can prevent a workout scenario from affecting the PPG module by setting target received currents suitable for different workout scenarios, so that the current data obtained by the PD satisfies a stable value range, and the smart watch can obtain relatively accurate human body characteristics by monitoring in different workout scenarios.

In a possible implementation, alternatively, the smart watch may match different LED target sending currents for different workout modes, so that the smart watch can reduce the impact of the extreme workout mode on the PPG module by using an appropriate LED sending current. In this way, the current data reflected by the skin tissue and obtained by the PD can better reflect real human body data of the user.

It can be understood that the above-mentioned target received current, target light sequence, and target sending current may be preset in the smart watch, or may be obtained based on learning from historical monitoring data when the user monitors human body data in different scenarios, which is not limited in the embodiments of this application.

S806: The smart watch instructs the LED in the PPG module to light up, and acquires the current data received by the PD.

In this embodiment of this application, the smart watch may instruct at least one LED in the PPG module to light up, and acquire current data corresponding to at least one PD in the PPG module as the current data received by the PD.

Figure 12:
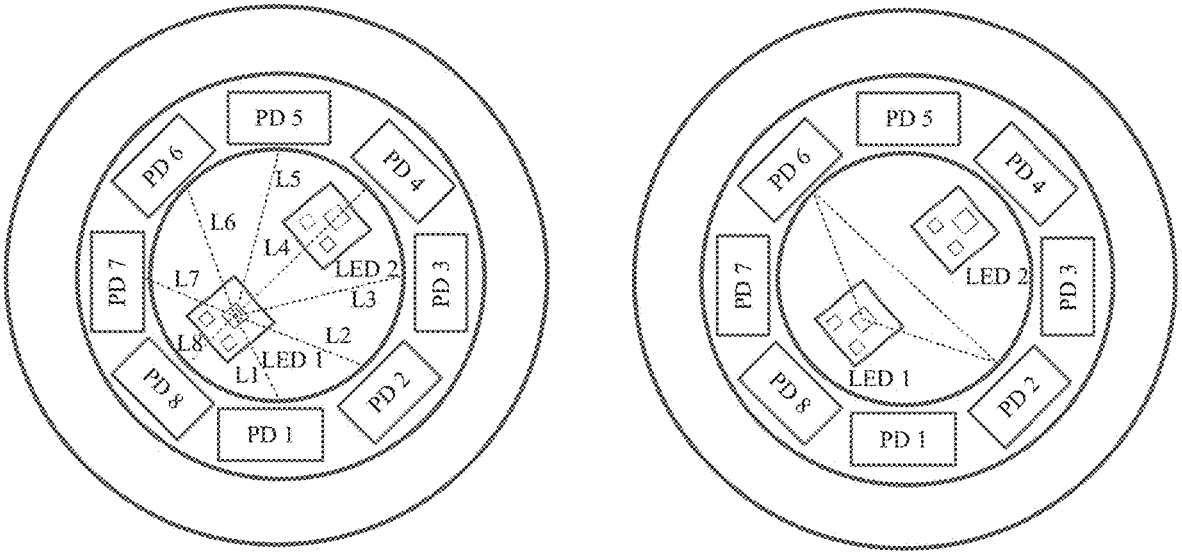
FIG. 12 is a schematic diagram of light path channels according to an embodiment of this application.

For example, FIG. 12 is a schematic diagram of light path channels according to an embodiment of this application. The embodiment corresponding to FIG. 12 is illustrated with an example in which the PPG module includes two LEDs and eight PDs.

As shown in a in FIG. 12, in the structure of the PPG module, the transmission of light signals between any LED (for example, LED 1) and the PDs (for example, PD 1 to PD 8) may constitute eight light path channels, for example, a light path channel L1 formed between LED 1 and PD 1, a light path channel L2 formed between LED 1 and PD 2, a light path channel L3 formed between LED 1 and PD 3, a light path L4 formed between LED 1 and PD4, a light path channel L5 formed between LED 1 and PD 5, a light path channel L6 formed between LED 1 and PD 6, a light path channel L7 formed between LED 1 and PD 7, and a light path channel L8 formed between LED 1 and PD 8.

For example, the smart watch may use at least one LED, for example, LED 1, to transmit a light signal corresponding to a preset current value, and use at least one of the eight PDs to obtain current data corresponding to the received light signal. For example, in the screen shown by a in FIG. 12, the smart watch may select a PD corresponding to the light path channel L3 (or L5) farthest from LED 1 among the eight PDs, for example, PD 3 (or PD 5) as the PD for receiving the current data. Altematively, in the screen shown in b in FIG. 12, the smart watch may select a pair of PDs (or a pair of PDs in a symmetrical structure) farthest from LED 1, for example, P 2 and PD 3 as a pair of PDs for receiving the current data. In this case, four light path channels may be formed between LED 1 and the eight PDs.

In a possible implementation, for the PPG module shown in FIG. 12, alternatively, the smart watch may obtain current data received by three, four, or all of the PDs in the PPG module as the current data for feedback and adjustment, which is not limited in the embodiments of this application.

S807: The smart watch determines whether the current data satisfies the target received current.

In the embodiments of this application, the target received current may be a current threshold or a current range, which is not limited in the embodiments of this application. For example, a value of the target received current may be 5 μA, or ranges from 4.5 μA to 5.5 μA.

In a possible implementation, when using one PD in the PPG module to obtain the current data, the smart watch may determine whether the current data corresponding to the PD satisfies the target received current. Alternatively, when using a plurality of PDs in the PPG module to obtain the current data, the smart watch may separately determine whether the current data corresponding to any one of the plurality of PDs satisfies the target received current.

For example, when the smart watch determines that the current data received by the PD satisfies the target received current, the smart watch may perform a step shown in S809; or when the smart watch determines that the current data received by the PD does not satisfy the target received current, the smart watch may perform a step shown in S808.

S808: The smart watch adjusts a light emission current of the LED based on a preset step size.

In this embodiment of this application, the preset step size may be a current value for adjusting the light emission current of the LED. The light emission current may be a current value corresponding to the LED lighting up in the step shown in S806.

For example, when the current data received by the PD in the step shown in S806 is greater than the target received current in the step shown in S805, the smart watch may reduce the light emission current of the LED based on the preset step size; or when the current data received by the PD in the step shown in S806 is less than the target received current in the step shown in S805, the smart watch may increase the light emission current of the LED based on the preset step size. In this way, the current received by the PD satisfies a stable state by adjusting the light emission current of the LED.

In a possible implementation, when a plurality of light sources are emitted by the LED, the smart watch may separately adjust LED light emission currents corresponding to the plurality of light sources based on relationships between the current data and the target received current that respectively correspond to the plurality of light sources and that are obtained by the PD, so that the current data corresponding to each light source received by the PD can reach a stable state.

S809: The smart watch obtains a heart rate monitoring result through calculation based on the current data received by the PD, and displays a heart rate curve.

For example, the smart watch can convert the current data received by the PD into the heart rate monitoring result, for example, to obtain an electrocardiogram (electrocardiogram, ECG).

Figure 13:
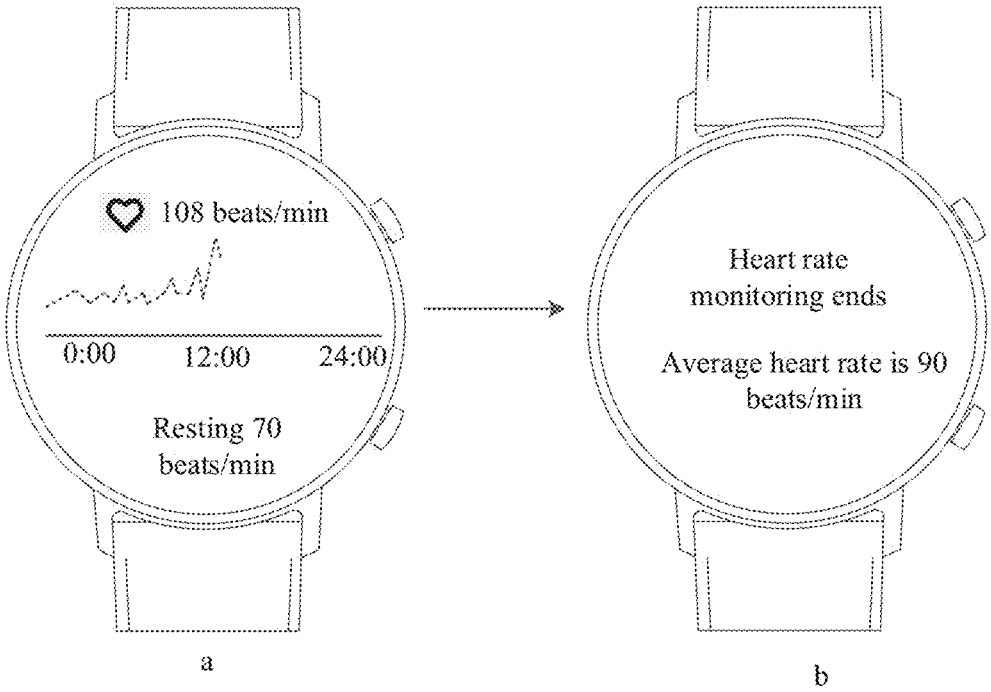
FIG. 13 is a schematic diagram of a screen displaying a heart rate curve according to an embodiment of this application.

For example, FIG. 13 is a schematic diagram of a screen displaying a heart rate curve according to an embodiment of this application. For example, the smart watch may calculate the heart rate based on the current data received by the PD. For example, the calculated current heart rate monitoring result is 108 beats/min and the calculated resting heart rate is 70 beats/min, and the heart rate monitoring result is displayed in the screen shown in a in FIG. 13.

S810: When the smart watch receives an operation of the user to end the heart rate monitoring, the smart watch instructs the LED in the PPG module to light off, and displays an end screen.

In the embodiments of this application, the operation for ending the heart rate monitoring may be: a voice operation, or a trigger operation for a control for ending the heart rate monitoring function, or a trigger operation for a control for ending the workout mode, or the like.

For example, when the smart watch receives the operation of the user to end the heart rate monitoring, the smart watch may display a screen shown by b in FIG. 13. The screen may include information for prompting the end of the heart rate monitoring, and information for prompting the heart rate monitoring result. For example, the screen may display: Heart rate monitoring ends. Average heart rate is 90 beats/min.

Based on this, based on a relationship between an actual current received by a PD and a target received current, the wearable device can feed back and adjust intensity of a current corresponding to a light signal emitted by a LED, so that the PD can obtain stable current data, and then the wearable device can obtain accurate human body characteristics by monitoring based on the stable current data.

On the basis of the embodiment corresponding to FIG. 8, in a possible implementation, the smart watch may further include an application layer, a system service layer, and an algorithm layer. The application layer may include a workout tracker application for human heart rate monitoring. The system service layer of the smart watch may include a heart rate service module. The algorithm layer may include a wearing algorithm module, a dimming algorithm module, and a heart rate algorithm module. For example, FIG. 14A and FIG. 14B are a schematic flowchart of another PPG-based control method according to an embodiment of this application.

Figure 14A:
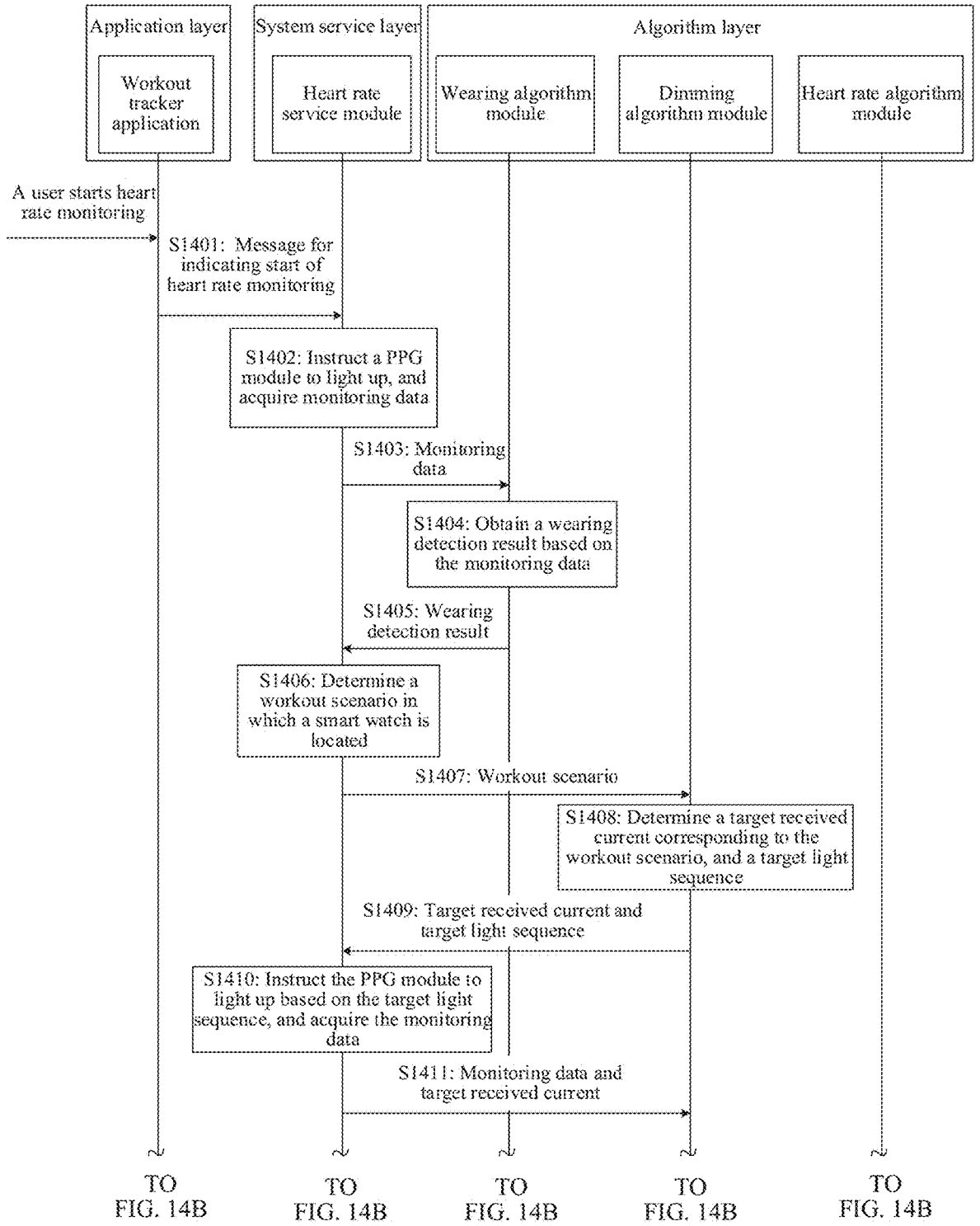
FIG. 14A and FIG. 14B are a schematic flowchart of another PPG-based control method according to an embodiment of this application.
Figure 14B:
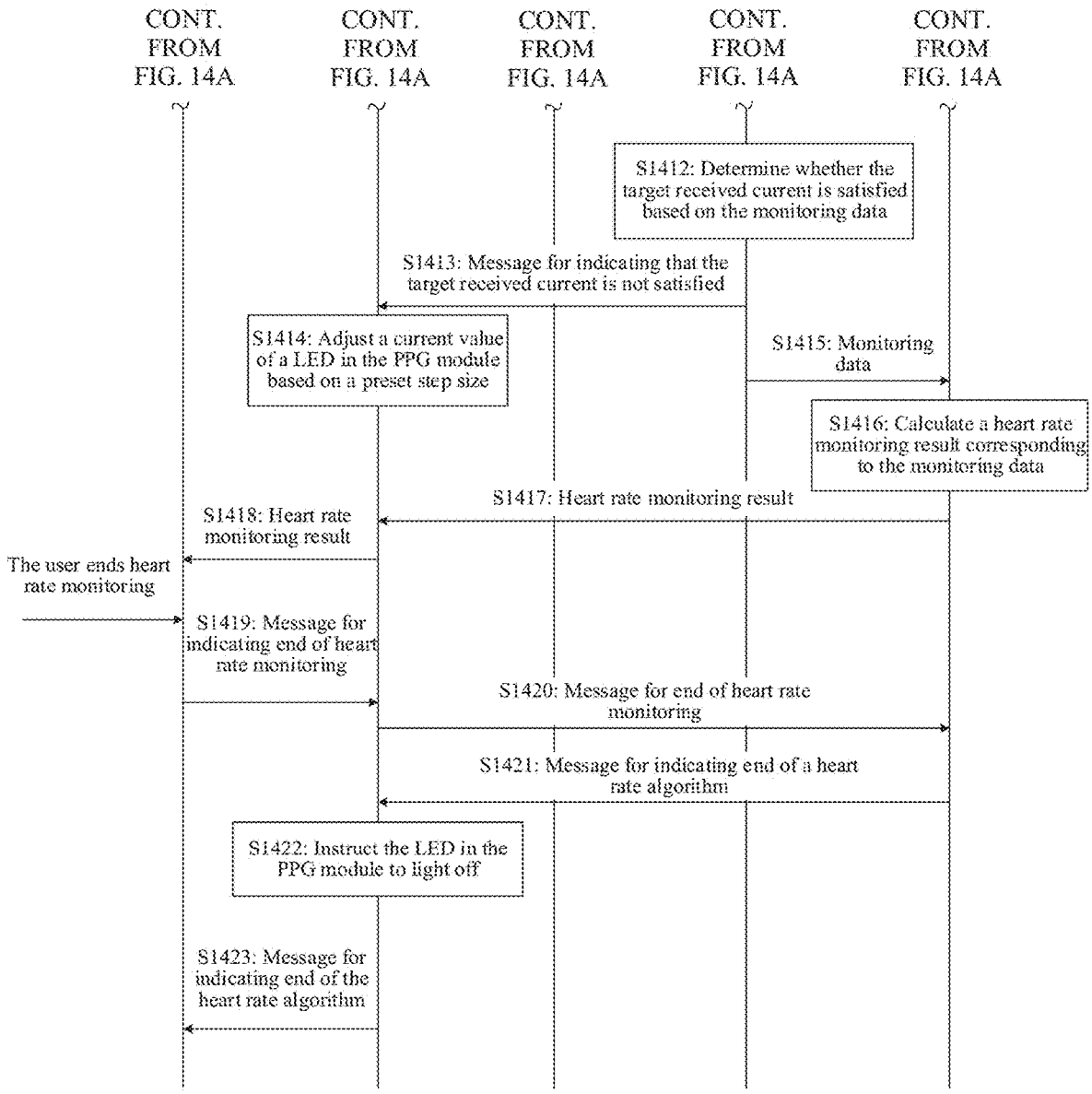

As shown in FIG. 14A and FIG. 14B, the PPG-based control method may include the following steps.

S1401: When the workout tracker application receives an operation of the user to trigger start of heart rate monitoring, the workout tracker application may send a message for indicating start of heart rate monitoring to the heart rate service module.

Correspondingly, the heart rate service module may receive the message for indicating the start of the heart rate monitoring.

For the operation of starting the heart rate monitoring, refer to the step shown in S801, which is not repeated herein.

S1402: The heart rate service module instructs the PPG module to light up, and acquires monitoring data.

In this embodiment of this application, the monitoring data may be current data received by at least one PD in the PPG module.

S1403: The heart rate service module sends the monitoring data to the wearing algorithm module.

Correspondingly, the wearing algorithm module may receive the monitoring data.

S1404: The wearing algorithm module obtains a wearing detection result based on the monitoring data.

For example, for the process in which the wearing algorithm module obtains the wearing detection result based on the monitoring data, refer to the process of the step shown in S802 in which the smart watch determines whether the wearing is currently detected, based on the current data received by the PD, which is not repeated herein.

S1405: The wearing detection algorithm module sends the wearing detection result to the heart rate service module.

Correspondingly, the heart rate service module may receive the wearing detection result.

S1406: The heart rate service module determines a workout scenario in which the smart watch is located.

In this embodiment of this application, when the wearing detection result indicates that the wearing is currently satisfied, the heart rate service module may perform the step shown in S1406; or when the wearing detection result indicates that the wearing is not currently satisfied, the heart rate service module may instruct the workout tracker application to display the screen shown in FIG. 10.

For example, for the process in which the heart rate service module determines the workout scenario in which the smart watch is located, refer to the step shown in S804, which is not repeated herein.

S1407: The heart rate service module sends the workout scenario to the dimming algorithm module.

Correspondingly, the dimming algorithm module may receive the workout scenario.

S1408: The dimming algorithm module determines a target received current corresponding to the workout scenario, and a target light sequence.

In this embodiment of this application, for the functions of the target received current and the target light sequence, refer to the description in the step shown in S805, which is not repeated herein.

S1409: The dimming algorithm module sends the target received current and the target light sequence to the heart rate service module.

Correspondingly, the heart rate service module may receive the target received current and the target light sequence.

S1410: The heart rate service module instructs the PPG module to light up based on the target light sequence, and acquires the monitoring data.

In this embodiment of this application, the monitoring data may be current data received by at least one PD in the PPG module.

S1411: The heart rate service module sends the monitoring data and the target received current to the dimming algorithm module.

Correspondingly, the dimming algorithm module may receive the monitoring data and the target received current.

S1412: The dimming algorithm module determines whether the target received current is satisfied based on the monitoring data.

In this embodiment of this application, for the determining by the dimming algorithm module of whether the target received current is satisfied based on the monitoring data, refer to the step shown in S807, which is not repeated herein.

For example, when the dimming algorithm module determines that the monitoring data does not satisfy the target received current, the dimming algorithm module may perform the step shown in S1413; or when the dimming algorithm module determines that the monitoring data satisfies the target received current, the dimming algorithm module may perform the step shown in S1415.

S1413: The dimming algorithm module sends a message for indicating that the target received current is not satisfied to the heart rate service module.

Correspondingly, the heart rate service module may receive the message for indicating that the target received current is not satisfied.

S1414: The heart rate service module adjusts a current value of a LED in the PPG module based on a preset step size.

It can be understood that, for the process in which the heart rate service module adjusts the current value of the LED in the PPG module based on the preset step size, refer to the step shown in S808, which is not repeated herein.

It can be understood that the heart rate service module may continue acquiring the monitoring data obtained by the PD based on the adjusted current value of the LED, so that the module in the wearable device can cyclically perform the steps shown in S1411 to S1414 until the dimming algorithm module determines that the target received current is currently satisfied based on the monitoring data.

S1415: The dimming algorithm module sends the monitoring data to the heart rate algorithm module.

Correspondingly, the heart rate algorithm module may receive the monitoring data.

S1416: The heart rate algorithm module calculates a heart rate monitoring result corresponding to the monitoring data.

S1417: The heart rate algorithm module sends the heart rate monitoring result to the heart rate service module.

Correspondingly, the heart rate service module may receive the heart rate monitoring result.

S1418: The heart rate service module sends the heart rate monitoring result to the workout tracker application.

Correspondingly, the workout tracker application may receive the heart rate monitoring result.

In a possible implementation, the workout tracker application may further display a screen corresponding to the heart rate curve shown by a in FIG. 13.

S1419: When the workout tracker application receives an operation of the user to trigger end of the heart rate monitoring, the workout tracker application may send a message for indicating end of heart rate monitoring to the heart rate service module.

Correspondingly, the heart rate service module may receive the message for indicating the end of the heart rate monitoring.

S1420: The heart rate service module sends the message for indicating start of heart rate monitoring to the heart rate algorithm module.

Correspondingly, the heart rate algorithm module may receive the message for indicating the end of the heart rate monitoring.

S1421: The heart rate algorithm module sends a message for indicating the end of a heart rate algorithm to the heart rate service module.

Correspondingly, the heart rate service module may receive the message for indicating the end of the heart rate algorithm.

S1422: The heart rate service module instructs the LED in the PPG module to light off.

S1423: The heart rate service module sends the message for indicating the end of the heart rate algorithm to the workout tracker application.

Correspondingly, the workout tracker application may receive the message for indicating the end of the heart rate algorithm.

In a possible implementation, a screen of end of the heart rate monitoring shown by b in FIG. 13 may be displayed in the workout tracker application.

Based on this, based on a relationship between an actual current received by a PD and a target received current, the wearable device can feed back and adjust intensity of a current corresponding to a light signal emitted by a LED, so that the PD can obtain stable current data, and then the wearable device can obtain accurate human body characteristics by monitoring based on the stable current data.

It can be understood that the interface provided in the embodiments of this application is only an example, and does not constitute a limitation on the embodiments of this application.

The methods provided in the embodiments of this application have been described above with reference to FIG. 8 to FIG. 14A and FIG. 14B, and the electronic device provided in the embodiments of this application for performing the foregoing methods is described below.

Figure 15:
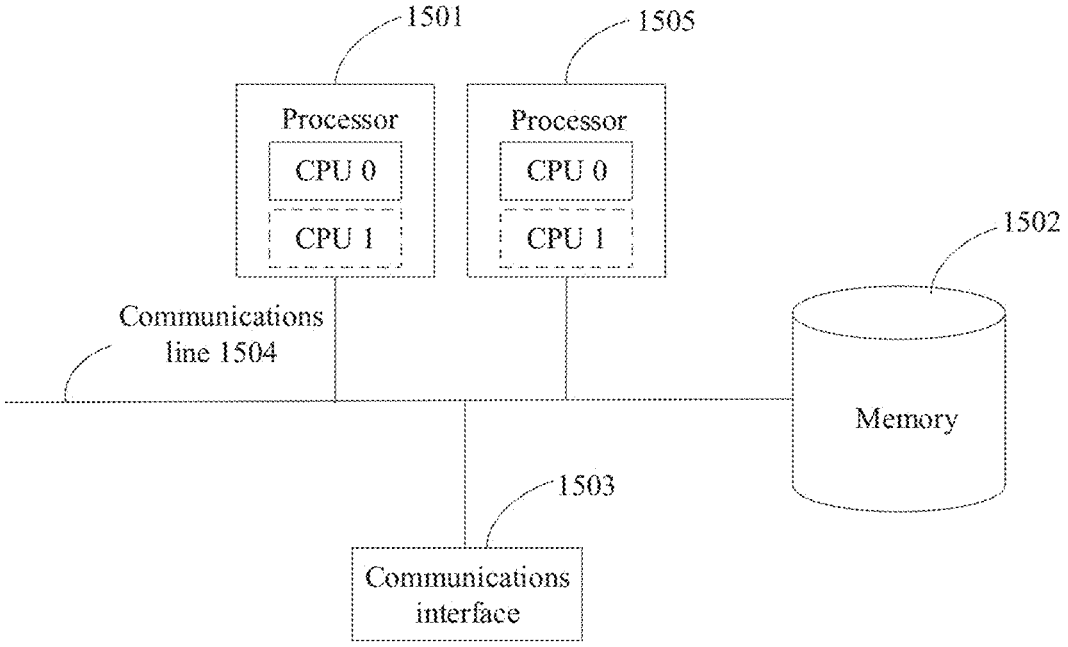
FIG. 15 is a schematic diagram of a hardware structure of an electronic device according to an embodiment of this application.

For example, FIG. 15 is a schematic diagram of a hardware structure of an electronic device according to an embodiment of this application. The electronic device may be the wearable device in the embodiments of this application.

As shown in FIG. 15, the electronic device includes a processor 1501, a communications line 1504, and at least one communications interface (a communications interface 1503 in FIG. 15 is an example for illustration).

The processor 1501 may be a general-purpose central processing unit (central processing unit, CPU), a microprocessor, an application-specific integrated circuit (application-specific integrated circuit, ASIC), or one or more integrated circuits configured to control program execution of the solutions in this application.

The communications line 1504 may include a circuit for transferring information between the foregoing components.

The communications interface 1503 uses any apparatus such as a transceiver, and is configured to communicate with another device or communications network, for example, the Ethernet or a wireless local area network (wireless local area network, WLAN).

Possibly, the electronic device may further include a memory 1502.

The memory 1502 may be a read-only memory (read-only memory, ROM) or another type of static storage device that can store static information and instructions, a random access memory (random access memory, RAM), or another type of static storage device that can store information and instructions, or may be an electrically erasable programmable read-only memory (electrically erasable programmable read-only memory, EEPROM), a compact disc read-only memory (compact disc read-only memory, CD-ROM) or other optical disc storage, an optical disk storage (including compact discs, laser discs, optical discs, digital versatile discs, Blu-ray discs, etc.). a magnetic disk storage medium or other magnetic storage device, or any other medium that can be used to carry or store expected program code having an instruction or data structure form and be accessible by a computer, which is not limited thereto. The memory may exist independently, and is connected to the processor through the communications line 1504. Alternatively. the memory may be integrated with the processor.

The memory 1502 is configured to store computer-executable instructions for performing the solutions in this application, and the processor 1501 controls execution of the computer-executable instructions. The processor 1501 is configured to execute the computer-executable instructions stored in the memory 1502, to implement the method provided in the embodiments of this application.

Possibly, the computer-executable instructions in this embodiment of this application may also be referred to as application program code. This is not specifically limited in this embodiment of this application.

During specific implementation, in an embodiment, the processor 1501 may include one or more CPUs, for example, a CPU 0 and a CPU 1 in FIG. 15.

During specific implementation, in an embodiment, the electronic device may include a plurality of processors, for example, the processor 1501 and a processor 1505 in FIG. 15. Each of the processors may be a single-core (single-CPU) processor, or may be a multi-core (multi-CPU) processor. The processor herein may be one or more devices, circuits, and/or processing cores configured to process data (for example. computer program instructions).

In the foregoing embodiments. the instructions stored in the memory for execution by the processor may be implemented in the form of a computer program product. The computer program product may be written in the memory in advance, or downloaded and installed in the memory in the form of software.

The computer program product includes one or more computer instructions. When the computer program instructions are loaded and executed on the computer, the procedures or functions according to the embodiments of this application are all or partially generated. The computer may be a general-purpose computer, a dedicated computer, a computer network, or other programmable apparatuses. The computer instructions may be stored in a computer-readable storage medium or transmitted from one computer-readable storage medium to another computer-readable storage medium. For example, the computer instructions may be transmitted from a website, computer, server, or data center to another website, computer, server, or data center in a wired (for example, through a coaxial cable, an optical fiber, or a digital subscriber line (digital subscriber line, DSL)) or wireless (for example, through infrared, radio, or microwave) manner. The computer-readable storage medium may be any usable medium accessible by the computer, or a data storage device, such as a server or a data center, integrating one or more usable media. For example, the usable medium may include a magnetic medium (for example, a floppy disk, a hard disk, or a magnetic tape), an optical medium (for example, a digital versatile disc (digital versatile disc, DVD)), a semiconductor medium (for example, a solid-state drive (solid state disk, SSD)), or the like.

An embodiment of this application further provides a computer-readable storage medium. All or a part of the method described in the foregoing embodiments may be implemented by software, hardware. firmware, or any combination thereof. The computer-readable medium may include both a computer storage medium and a communications medium, and may further include any medium that transfers a computer program from one place to another. The storage medium may be any target medium accessible by a computer.

As a possible design, the computer-readable medium may include a compact disc read-only memory (compact disc read-only memory, CD-ROM), a RAM, a ROM, an EEPROM, or another optical disc storage. The computer-readable medium may include a magnetic disk memory or another magnetic disk storage device. In addition, any connection line may also be properly termed a computer-readable medium. For example, if the coaxial cable, a fiber-optic cable, a twisted pair, a DSL, or a wireless technology such as infrared, radio, and microwave are used to transmit software from a website, a server, or another remote source. the coaxial cable, the fiber-optic cable, the twisted pair, the DSL, or the wireless technology such as infrared, radio, and microwave are included in the definition of medium. The disk and disc, as used herein, include a compact disc (CD), a laser disc, an optical disc, a digital versatile disc (digital versatile disc, DVD), a floppy disk, and a Blu-ray disc. The disks typically reproduce data magnetically, while discs utilize laser to optically reproduce data.

A combination thereof shall also fall within the scope of the computer-readable medium. The foregoing description illustrates merely specific implementations of the present invention, but the scope of protection of the present invention is not limited thereto. Any variation or replacement readily figured out by those skilled in the art within the technical scope disclosed in the present invention shall fall within the scope of protection of the present invention. Therefore, the scope of protection of the present invention shall be subject to the scope of protection of the claims.

What is claimed is:

1. A photoplethysmography (PPG) based control method, applied to an electronic device comprising a PPG module, the PPG module comprising a plurality of light-emitting diodes (LEDs) and a plurality of photodiodes (PDs), wherein the method comprises:

storing, in a memory of the electronic device, a predetermined correspondence between a plurality of predefined workout scenarios and respective target received currents for monitoring of human body characteristics using the PPG module;

determining, by the electronic device from the plurality of predefined workout scenarios, a target workout scenario in which the electronic device is located;

determining, by the electronic device based on the predetermined correspondence, the target received current corresponding to the target workout scenario;

using, by the electronic device, the plurality of LEDs to emit a light signal corresponding to a first current toward a human body;

using, by the electronic device, at least one of the plurality of PDs to obtain a second current returned by the light signal corresponding to the first current via a human tissue of the human body; and reducing, by the electronic device, the first current by using a preset first current step size when the electronic device determines that the second current is greater than the target received current; or increasing, by the electronic device, the first current by using the preset first current step size when the electronic device determines that the second current is less than the target received current.

2. The method according to claim 1, wherein the determining, by the electronic device, a target scenario in which the electronic device is located comprises:

obtaining, by the electronic device, first data, wherein the first data comprises at least one of:

acceleration data, angular acceleration data, barometric pressure data, or temperature data; and detecting, by the electronic device, the first data by using a preset rule to obtain the target scenario.

3. The method according to claim 1, wherein the determining, by the electronic device, a target scenario in which the electronic device is located comprises:

receiving, by the electronic device, a first operation, wherein the first operation is used to set a monitoring scenario for monitoring of human body characteristics using the PPG module; and in response to the first operation, determining, by the electronic device, the target scenario in which the electronic device is located.

4. The method according to claim 1, wherein the LED is a tricolor LED that produces red, green, and infrared light, the tricolor LED emits at least one third current, and the obtaining a second current returned by the light signal corresponding to the first current via a human tissue comprises:

obtaining at least one fourth current returned by a light signal corresponding to the at least one third current via the human tissue.

5. The method according to claim 4, wherein the method further comprises:

reducing, by the electronic device, the at least one third current by using the preset first current step size when the electronic device determines that the at least one fourth current is greater than a received current corresponding to the at least one light source in the tricolor LED; of increasing, by the electronic device, the at least one third current by using the preset first current step size when the electronic device determines that the at least one fourth current is less than the received current corresponding to the at least one light source in the tricolor LED.

6. The method according to claim 4, wherein before the using, by the electronic device, the plurality of LEDs to emit a light signal corresponding to a first current, the method further comprises:

monitoring, by the electronic device, at least one of: heart rate monitoring, blood oxygen monitoring, or respiratory rate monitoring, to generate monitoring content;

determining intensity of illumination in which the electronic device is located;

determining, by the electronic device, a target light sequence based on the monitoring content and the intensity of illumination in which the electronic device is located, wherein the target light sequence is used to indicate a light emission status of light sources in the LEDs for monitoring of human body characteristics using the PPG module; and the using, by the electronic device, the plurality of LEDs to emit a light signal corresponding to a first current comprises: using, by the electronic device according to the target light sequence, the plurality of LEDs to emit the light signal corresponding to the first current.

7. The method according to claim 6, wherein the determining, by the electronic device, a target light sequence based on monitoring content and the intensity of illumination in which the electronic device is located comprises:

determining, by the electronic device, that the target light sequence is that the LED satisfies green light emission, when the monitoring content is heart rate monitoring and the intensity of illumination in which the electronic device is located is greater than or equal to an illumination intensity threshold; or determining, by the electronic device, that the target light sequence is that the LED satisfies infrared light emission, when the monitoring content is heart rate monitoring and the intensity of illumination in which the electronic device is located is less than the illumination intensity threshold.

8. The method according to claim 1, wherein before the using, by the electronic device, the plurality of LEDs to emit a light signal corresponding to a first current, the method further comprises:

receiving, by the electronic device, an operation, wherein the operation is used to indicate start of monitoring of human body characteristics;

in response to the second operation, using, by the electronic device, the plurality of LEDs to emit a light signal corresponding to a third current; and using, by the electronic device, at least one of the plurality of PDs to obtain a sixth current returned by the light signal corresponding to the third current via the human tissue; and the using, by the electronic device, the plurality of LEDs to emit a light signal corresponding to a first current comprises: using, by the electronic device, the plurality of LEDs to emit the light signal corresponding to the first current, when the electronic device determines that the sixth current satisfies a first preset current.

9. The method according to claim 8, wherein the method further comprises:

displaying, by the electronic device, first prompt information when the electronic device determines that the sixth current does not satisfy the first preset current, wherein the first prompt information is used to indicate that wearing of the electronic device has not been detected.

10. The method according to claim 1, wherein the method further comprises:

receiving, by the electronic device, an operation, wherein the operation is used to indicate end of monitoring of human body characteristics; and in response to the operation, obtaining, by the electronic device, a result of the monitoring of human body characteristics based on the second current.

11. The method according to claim 1, wherein the electronic device comprises a wearable device, and the wearable device comprises one of the following: a smart watch, a smart bracelet, or smart glasses.

12. An electronic device, comprising:

a photoplethysmography (PPG) module, wherein the PPG module comprising a plurality of light-emitting diodes (LEDs) and a plurality of photodiodes (PDs);

at least one processor; and one or more memories coupled to the at least one processor and storing programming instructions for execution by the at least one processor to cause the electronic device to perform operations comprising:

storing, in one of the one or more memories of the electronic device, a predetermined correspondence between a plurality of predefined workout scenarios and respective target received currents for monitoring of human body characteristics using the PPG module;

determining, by the electronic device from the plurality of predefined workout scenarios, a target workout scenario in which the electronic device is located;

determining, by the electronic device based on the predetermined correspondence, the target received current corresponding to the target workout scenario;

using, by the electronic device, the plurality of LEDs to emit a light signal corresponding to a first current toward a human body;

using, by the electronic device, at least one of the plurality of PDs to obtain a second current returned by the light signal corresponding to the first current via a human tissue of the human body; and reducing, by the electronic device, the first current by using a preset first current step size when the electronic device determines that the second current is greater than the target received current, or increasing, by the electronic device, the first current by using the preset first current step size when the electronic device determines that the second current is less than the target received current.

13. The electronic device according to claim 12, wherein the determining, by the electronic device, a target scenario in which the electronic device is located comprises:

obtaining, by the electronic device, first data, wherein the first data comprises at least one of:

acceleration data, angular acceleration data, barometric pressure data, or temperature data; and detecting, by the electronic device, the first data by using a preset rule to obtain the target scenario.

14. The electronic device according to claim 12, wherein the determining, by the electronic device, a target scenario in which the electronic device is located comprises:

receiving, by the electronic device, a first operation, wherein the first operation is used to set a monitoring scenario for monitoring of human body characteristics using the PPG module; and in response to the first operation, determining, by the electronic device, the target scenario in which the electronic device is located.

15. The electronic device according to claim 12, wherein the LED is a tricolor LED that produces red, green, and infrared light, the tricolor LED emits at least one third current, and the obtaining a second current returned by the light signal corresponding to the first current via a human tissue comprises:

obtaining at least one fourth current returned by a light signal corresponding to the at least one third current via the human tissue.

16. The electronic device according to claim 15, wherein the operations further comprise:

reducing, by the electronic device, the at least one third current by using the preset first current step size when the electronic device determines that the at least one fourth current is greater than a received current corresponding to the at least one light source in the tricolor LED; or increasing, by the electronic device, the at least one third current by using the preset first current step size when the electronic device determines that the at least one fourth current is less than the received current corresponding to the at least one light source in the tricolor LED.

17. The electronic device according to claim 15, wherein before the using, by the electronic device, the plurality of LEDs to emit a light signal corresponding to a first current, the operations further comprise:

monitoring, by the electronic device, at least one of: heart rate monitoring, blood oxygen monitoring, or respiratory rate monitoring, to generate monitoring content;

determining intensity of illumination in which the electronic device is located;

determining, by the electronic device, a target light sequence based on the monitoring content and the intensity of illumination in which the electronic device is located, wherein the target light sequence is used to indicate a light emission status of light sources in the LEDs for monitoring of human body characteristics using the PPG module; and the using, by the electronic device, the plurality of LEDs to emit a light signal corresponding to a first current comprises: using, by the electronic device according to the target light sequence, the plurality of LEDs to emit the light signal corresponding to the first current.

18. The electronic device according to claim 17, wherein the determining, by the electronic device, a target light sequence based on monitoring content and the intensity of illumination in which the electronic device is located comprises:

determining, by the electronic device, that the target light sequence is that the LED satisfies green light emission, when the monitoring content is heart rate monitoring and the intensity of illumination in which the electronic device is located is greater than or equal to an illumination intensity threshold; or determining, by the electronic device, that the target light sequence is that the LED satisfies infrared light emission, when the monitoring content is heart rate monitoring and the intensity of illumination in which the electronic device is located is less than the illumination intensity threshold.

19. One or more non-transitory computer-readable media storing computer instructions, that when executed by one or more processors, cause an electronic device to perform operations, wherein the electronic device comprises a photoplethysmography (PPG) module, wherein the PPG module comprising a plurality of light-emitting diodes (LEDs) and a plurality of photodiodes (PDs), and the operations comprise:

storing, in a memory of the electronic device, a predetermined correspondence between a plurality of predefined workout scenarios and respective target received currents for monitoring of human body characteristics using the PPG module;

determining, by the electronic device from the plurality of predefined workout scenarios, a target workout scenario in which the electronic device is located;

determining, by the electronic device based on the predetermined correspondence, the target received current corresponding to the target workout scenario;

using, by the electronic device, the plurality of LEDs to emit a light signal corresponding to a first current toward a human body;

using, by the electronic device, at least one of the plurality of PDs to obtain a second current returned by the light signal corresponding to the first current via a human tissue of the human body; and reducing, by the electronic device, the first current by using a preset first current step size when the electronic device determines that the second current is greater than the target received current, or increasing, by the electronic device, the first current by using the preset first current step size when the electronic device determines that the second current is less than the target received current.

* * * * *